US008142282B2

(12) United States Patent
Canessa et al.

(10) Patent No.: US 8,142,282 B2
(45) Date of Patent: Mar. 27, 2012

(54) CONSOLE INTEGRATED DOWNLOADABLE GAME SERVICE

(75) Inventors: Gregory Joseph Canessa, Seattle, WA (US); Jonathan Todd David, Seattle, WA (US); Eric Boller Fleegal, Bothell, WA (US); Michael Anthony Harlich, Monroe, WA (US); Brian Hunter Ostergren, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 790 days.

(21) Appl. No.: 11/599,704

(22) Filed: Nov. 15, 2006

(65) Prior Publication Data

US 2008/0113789 A1 May 15, 2008

(51) Int. Cl.
*A63F 9/24* (2006.01)

(52) U.S. Cl. ..... 463/29; 463/42; 705/59

(58) Field of Classification Search ..... 463/1–47; 705/1, 26, 37, 52, 59
See application file for complete search history.

(56) References Cited

U.S. PATENT DOCUMENTS

| | | | | |
|---|---|---|---|---|
| 5,708,709 | A * | 1/1998 | Rose | 705/59 |
| 5,791,992 | A | 8/1998 | Crump et al. | 463/41 |
| 5,883,955 | A * | 3/1999 | Ronning | 705/52 |
| 6,226,618 | B1 * | 5/2001 | Downs et al. | 705/1 |
| 6,334,214 | B1 * | 12/2001 | Horstmann | 717/170 |
| 6,544,126 | B2 | 4/2003 | Sawano et al. | 463/42 |
| 6,805,634 | B1 | 10/2004 | Wells et al. | 463/42 |
| 6,941,353 | B1 * | 9/2005 | Lane | 709/219 |
| 7,115,033 | B1 | 10/2006 | Timperley | 463/20 |
| 2001/0010046 | A1 * | 7/2001 | Muyres et al. | 705/52 |
| 2002/0002510 | A1 | 1/2002 | Sharp et al. | 705/26 |
| 2002/0082939 | A1 * | 6/2002 | Clark et al. | 705/26 |
| 2003/0084306 | A1 * | 5/2003 | Abburi et al. | 713/188 |
| 2003/0181242 | A1 * | 9/2003 | Lee et al. | 463/42 |
| 2004/0121835 | A1 | 6/2004 | Willis et al. | 463/20 |
| 2004/0172533 | A1 * | 9/2004 | DeMello et al. | 713/164 |
| 2005/0054431 | A1 | 3/2005 | Walker et al. | 463/25 |
| 2005/0055309 | A1 * | 3/2005 | Williams et al. | 705/40 |
| 2005/0282636 | A1 | 12/2005 | O'Brien | 463/42 |
| 2006/0048132 | A1 * | 3/2006 | Chen et al. | 717/168 |
| 2006/0064761 | A1 * | 3/2006 | Multerer et al. | 726/27 |
| 2006/0085642 | A1 | 4/2006 | Multerer et al. | 713/168 |

(Continued)

FOREIGN PATENT DOCUMENTS

WO WO 2005092458 10/2005

OTHER PUBLICATIONS

"Automotive Computing with Game Console Hardware," http://www.sce.carleton.ca/faculty/wainer/students/dashbox/finalreport.pdf, (2005).

(Continued)

*Primary Examiner* — Peter DungBa Vo
*Assistant Examiner* — Steve Rowland
(74) *Attorney, Agent, or Firm* — Alleman Hall McCoy Russell & Tuttle LLP

(57) ABSTRACT

A user interface screen is displayed on a gaming device that provides both a first selectable item that indicates the ability to download games to the gaming device and a second selectable item that indicates the ability to view games that are stored on at least one storage device in the gaming device. The user interface is associated with the gaming device instead of with an individual application.

11 Claims, 25 Drawing Sheets

U.S. PATENT DOCUMENTS

| | | | | |
|---|---|---|---|---|
| 2006/0136964 | A1* | 6/2006 | Diez et al. | 725/37 |
| 2006/0183542 | A1 | 8/2006 | Ng et al. | 463/31 |
| 2006/0191016 | A1* | 8/2006 | Ostergren et al. | 726/27 |
| 2006/0196686 | A1 | 9/2006 | Gatto et al. | 173/191 |

OTHER PUBLICATIONS

"A Mobile Gaming Platform for the IMS," Network and System Support for Games, Porc. of 3rd ACM SIGCOMM Workshop on System Support for Games (2004).

"Keeping Secrets in Hardware: The Microsoft Xbox™ Case Study," http://web.mit.edu/bunnie/www/proj/anatak/AIM-2002-008.pdf (2002).

"Inside Xbox Graphics—A Powerful Game Platform Waiting in the Wings," http://www.ddj.com/dept/architect/184404199, (2001).

"Inside Xbox 360: An Interview with Jeff Henshaw," http://www.winsupersite.com/showcase/xbox360_inside_02.asp, (2005).

* cited by examiner

CONSOLE INTEGRATED DOWNLOADABLE GAME SERVICE

BACKGROUND

Historically, gaming consoles have been dedicated devices that connect to a monitor and that allow a user to play a game stored on a game cartridge or disc that is inserted into the gaming console. Thus, the games available to a user were provided on gaming modules or optical discs that the user had to purchase and bring home. When a user wanted to play a game, the user had to insert the module or disc into the gaming console. The game would typically automatically start when it was inserted into the console. When the user desired to play a different game, the existing game had to be removed from the gaming console and the new game had to be inserted into the gaming console.

Traditionally, gaming consoles had also been isolated from other devices other than a television monitor. As such, they were not viewed as devices that could be networked.

This changed with the introduction of the Microsoft XBOX® gaming console, which provided network connectivity for the gaming console. To take advantage of this network connectivity, Microsoft introduced a gaming disc known as Microsoft Arcade, which was able to use the network connection on the gaming console to reach a server through the Internet. By communicating with this server, code on the Arcade gaming disc was able to enumerate games that were stored on the server and that could be downloaded to the gaming console. The list of games available on the server was displayed to the user along with games that had previously been downloaded to the gaming device. Thus, in one display, the user saw both games that had been downloaded and games that had yet to be downloaded. By selecting one of the games that had not been downloaded yet, the user was able to download the game onto their gaming device for a fee. This fee was paid through a credit card transaction that required many interactions with the user in order to confirm the purchase.

Although games were downloaded and stored on the gaming device, they could not be viewed or played unless the Arcade disc was running in the gaming console. In addition, the downloaded games were not viewed as independent games by the gaming console but instead were considered content for the Arcade disc.

The discussion above is merely provided for general background information and is not intended to be used as an aid in determining the scope of the claimed subject matter.

SUMMARY

A user interface screen is displayed on a gaming device that provides both a first selectable item that indicates the ability to download games to the gaming device and a second selectable item that indicates the ability to view games that are stored on at least one storage device in the gaming device. The user interface is associated with the gaming device instead of with an individual application.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 14-1 is a Purchase HUD user interface for downloading a demonstration version of a game.

FIG. 14-2 is a Purchase HUD user interface for purchasing a game.

DETAILED DESCRIPTION

Gaming System

Figure 1:
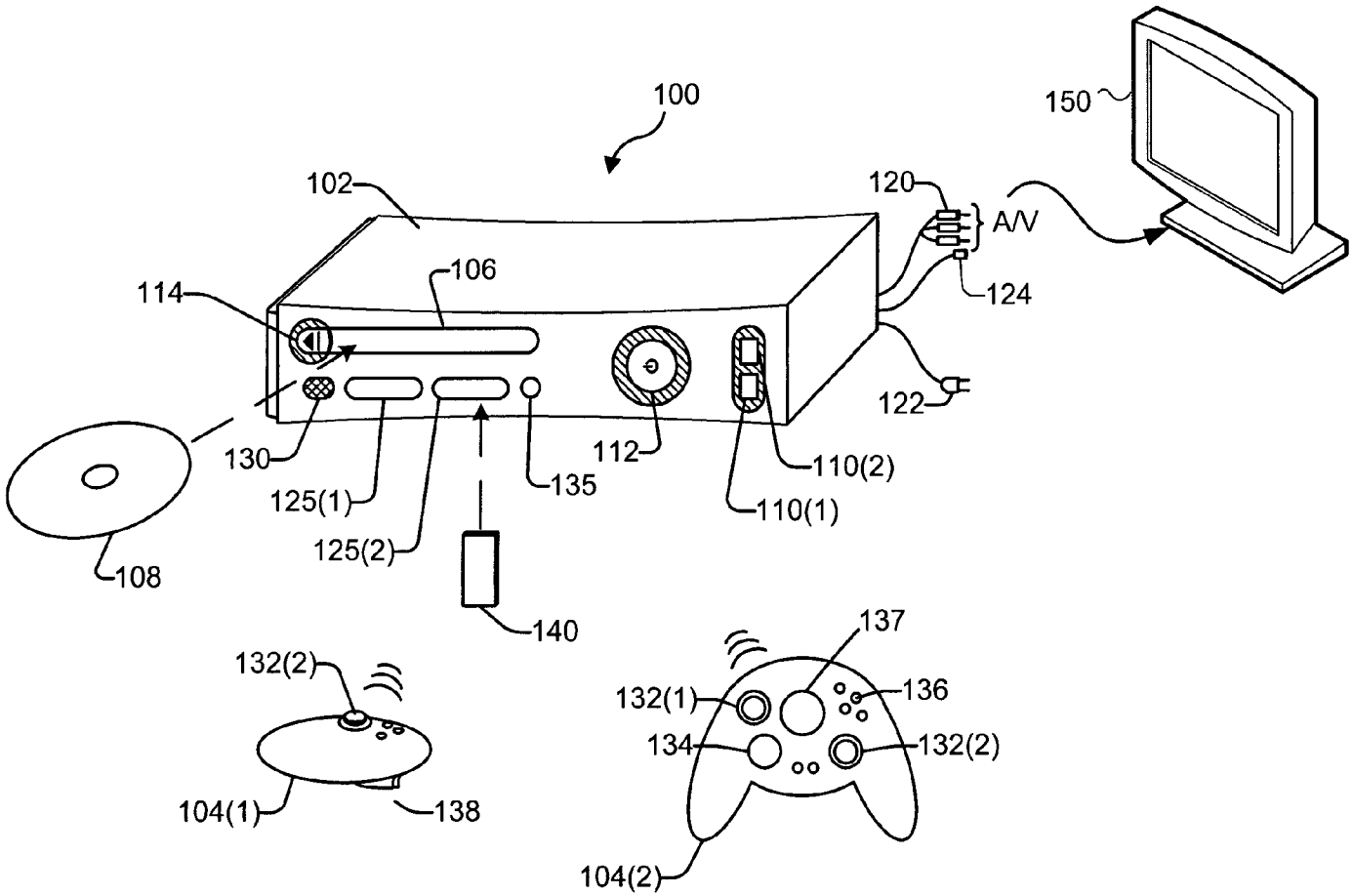
FIG. 1 is a diagram of external components of a gaming system.

FIG. 1 shows an exemplary gaming and media system 100. The following discussion of this Figure is intended to provide a brief, general description of a suitable environment in which certain methods may be implemented.

As shown in FIG. 1, gaming and media system 100 includes a game and media console (hereinafter "console") 102. Console 102 is configured to accommodate one or more wireless controllers, as represented by controllers 104(1) and 104(2). A command button 135 on console 102 is used to create a new wireless connection between one of the controllers and the console 102. Console 102 is equipped with an internal hard disk drive (not shown) and a media drive 106 that supports various forms of portable storage media, as represented by optical storage disc 108. Examples of suitable portable storage media include DVD, CD-ROM, game discs, and so forth. Console 102 also includes two memory unit card receptacles 125(1) and 125(2), for receiving removable flash-type memory units 140.

Console 102 also includes an optical port 130 for communicating wirelessly with one or more devices and two USB (Universal Serial Bus) ports 110(1) and 110(2) to support a wired connection for additional controllers, or other peripherals. In some implementations, the number and arrangement of additional ports may be modified. A power button 112 and an eject button 114 are also positioned on the front face of game console 102. Power button 112 is selected to apply power to the game console, and can also provide access to other features and controls, and eject button 114 alternately opens and closes the tray of a portable media drive 106 to enable insertion and extraction of a storage disc 108.

Console 102 connects to a television or other display (not shown) via A/V interfacing cables 120. In one implementation, console 102 is equipped with a dedicated A/V port (not shown) configured for content-secured digital communication using A/V cables 120 (e.g., A/V cables suitable for coupling to a High Definition Multimedia Interface "HDMI" port on a high definition monitor 150 or other display device). A power cable 122 provides power to the game console. Console 102 may be further configured with broadband capabilities, as represented by a cable or modem connector 124 to facilitate access to a network, such as the Internet.

Each controller 104 is coupled to console 102 via a wired or wireless interface. In the illustrated implementation, the controllers are USB-compatible and are coupled to console 102 via a wireless or USB port 110. Console 102 may be equipped with any of a wide variety of user interaction mechanisms. In an example illustrated in FIG. 1, each controller 104 is equipped with two thumbsticks 132(1) and 132(2), a D-pad 134, buttons 136, User Guide button 137 and two triggers 138. By pressing and holding User Guide button 137, a user is able to power-up or power-down console 102. By pressing and releasing User Guide button 137, a user is able to cause a User Guide Heads Up Display (HUD) user interface to appear over the current graphics displayed on monitor 150. The controllers described above are merely representative, and other known gaming controllers may be substituted for, or added to, those shown in FIG. 1.

In one implementation (not shown), a memory unit (MU) 140 may also be inserted into one of controllers 104(1) and 104(2) to provide additional and portable storage. Portable MUs enable users to store game parameters and entire games for use when playing on other consoles. In this implementation, each console is configured to accommodate two MUs 140, although more or less than two MUs may also be employed.

Gaming and media system 100 is generally configured for playing games stored on a memory medium, as well as for downloading and playing games, and reproducing pre-recorded music and videos, from both electronic and hard media sources. With the different storage offerings, titles can be played from the hard disk drive, from optical disk media (e.g., 108), from an online source, from a peripheral storage device connected to USB connections 110 or from MU 140.

Figure 2:
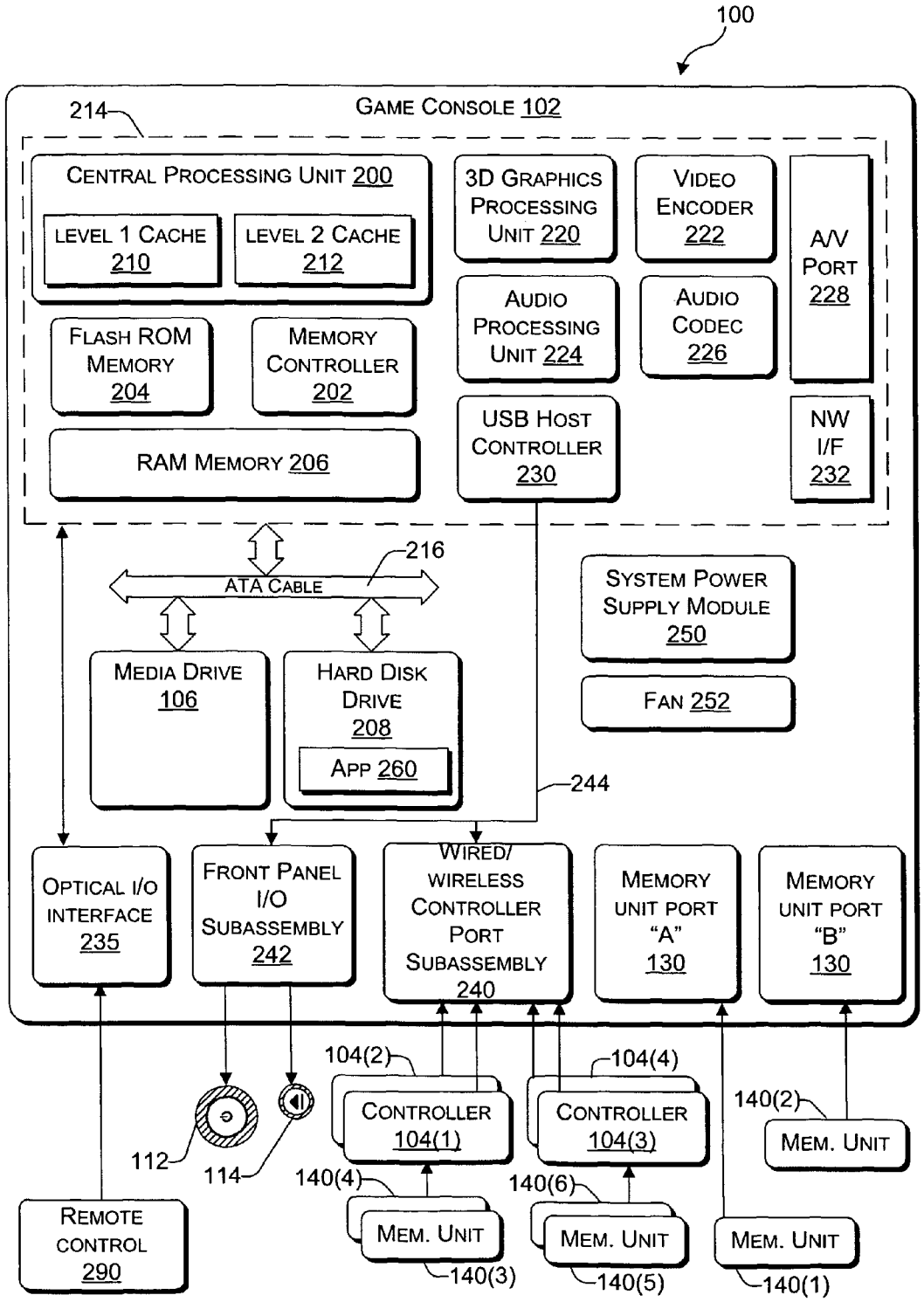
FIG. 2 is a block diagram of internal components of a gaming system.

FIG. 2 is a functional block diagram of gaming and media system 100 and shows functional components of gaming and media system 100 in more detail. Console 102 has a central processing unit (CPU) 200, and a memory controller 202 that facilitates processor access to various types of memory, including a flash Read Only Memory (ROM) 204, a Random Access Memory (RAM) 206, a hard disk drive 208, and media drive 106. In one implementation, CPU 200 includes a level 1 cache 210, and a level 2 cache 212 to temporarily store data and hence reduce the number of memory access cycles made to the hard drive, thereby improving processing speed and throughput.

CPU 200, memory controller 202, and various memory devices are interconnected via one or more buses (not shown). The details of the bus that is used in this implementation are not particularly relevant to understanding the subject matter of interest being discussed herein. However, it will be understood that such a bus might include one or more of serial and parallel buses, a memory bus, a peripheral bus, and a processor or local bus, using any of a variety of bus architectures. By way of example, such architectures can include an Industry Standard Architecture (ISA) bus, a Micro Channel Architecture (MCA) bus, an Enhanced ISA (EISA) bus, a Video Electronics Standards Association (VESA) local bus, and a Peripheral Component Interconnects (PCI) bus also known as a Mezzanine bus.

In one implementation, CPU 200, memory controller 202, ROM 204, and RAM 206 are integrated onto a common module 214. In this implementation, ROM 204 is configured as a flash ROM that is connected to memory controller 202 via a Peripheral Component Interconnect (PCI) bus and a ROM bus (neither of which are shown). RAM 206 is configured as multiple Double Data Rate Synchronous Dynamic RAM (DDR SDRAM) modules that are independently controlled by memory controller 202 via separate buses (not shown). Hard disk drive 208 and media drive 106 are shown connected to the memory controller via the PCI bus and an AT Attachment (ATA) bus 216. However, in other implementations, dedicated data bus structures of different types can also be applied in the alternative.

In some embodiments, ROM 204 contains an operating system kernel that controls the basic operations of the console and that exposes a collection of Application Programming Interfaces that can be called by games and other applications to perform certain functions and to obtain certain data.

A three-dimensional graphics processing unit 220 and a video encoder 222 form a video processing pipeline for high speed and high resolution (e.g., High Definition) graphics processing. Data are carried from graphics processing unit 220 to video encoder 222 via a digital video bus (not shown). An audio processing unit 224 and an audio codec (coder/decoder) 226 form a corresponding audio processing pipeline for multi-channel audio processing of various digital audio formats. Audio data are carried between audio processing unit 224 and audio codec 226 via a communication link (not shown). The video and audio processing pipelines output data to an A/V (audio/video) port 228 for transmission to a television or other display. In the illustrated implementation, video and audio processing components 220-228 are mounted on module 214.

FIG. 2 shows module 214 including a USB host controller 230 and a network interface 232. USB host controller 230 is shown in communication with CPU 200 and memory controller 202 via a bus (e.g., PCI bus) and serves as host for peripheral controllers 104(1)-104(4). Network interface 232 provides access to a network (e.g., Internet, home network, etc.) and may be any of a wide variety of various wire or wireless interface components including an Ethernet card, a modem, a Bluetooth module, a cable modem, and the like.

In the implementation depicted in FIG. 2, console 102 includes a controller support subassembly 240, for supporting up to four controllers 104(1)-104(4). The controller support subassembly 240 includes any hardware and software components needed to support wired and wireless operation with an external control device, such as for example, a media and game controller. A front panel I/O subassembly 242 supports the multiple functionalities of power button 112, the eject button 114, as well as any LEDs (light emitting diodes) or other indicators exposed on the outer surface of console 102. Subassemblies 240 and 242 are in communication with module 214 via one or more cable assemblies 244. In other implementations, console 102 can include additional controller subassemblies. The illustrated implementation also shows an optical I/O interface 235 that is configured to send and receive signals that can be communicated to module 214.

MUs 140(1) and 140(2) are illustrated as being connectable to MU ports "A" 130(1) and "B" 130(2) respectively. Additional MUs (e.g., MUs 140(3)-140(6)) are illustrated as being connectable to controllers 104(1) and 104(3), i.e., two MUs for each controller. Controllers 104(2) and 104(4) can also be configured to receive MUs (not shown). Each MU 140 offers additional storage on which games, game parameters, and other data may be stored. In some implementations, the other data can include any of a digital game component, an executable gaming application, an instruction set for expanding a gaming application, and a media file. When inserted into console 102 or a controller, MU 140 can be accessed by memory controller 202.

A system power supply module 250 provides power to the components of gaming system 100. A fan 252 cools the circuitry within console 102.

Under some embodiments, an application 260 comprising machine instructions is stored on hard disk drive 208. Application 260 provides a collection of user interfaces that are associated with console 102 instead of with an individual game. The user interfaces allow the user to select system settings for console 102, access media attached to console 102, view information about games, and utilize services provided by a server that is connected to console 102 through a network connection. When console 102 is powered on, various portions of application 260 are loaded into RAM 206, and/or caches 210 and 212, for execution on CPU 200. Although application 260 is shown as being stored on hard disk drive 208, in alternative embodiments, application 260 is stored in ROM 204 with the operating system kernel.

Gaming system 100 may be operated as a standalone system by simply connecting the system to a monitor, a television 150 (FIG. 1), a video projector, or an other display device. In this standalone mode, gaming system 100 enables one or more players to play games, or enjoy digital media, e.g., by watching movies, or listening to music. However, with the integration of broadband connectivity made available through network interface 232, gaming system 100 may further be operated as a participant in a larger network gaming community.

Networked Gaming System

Figure 3:
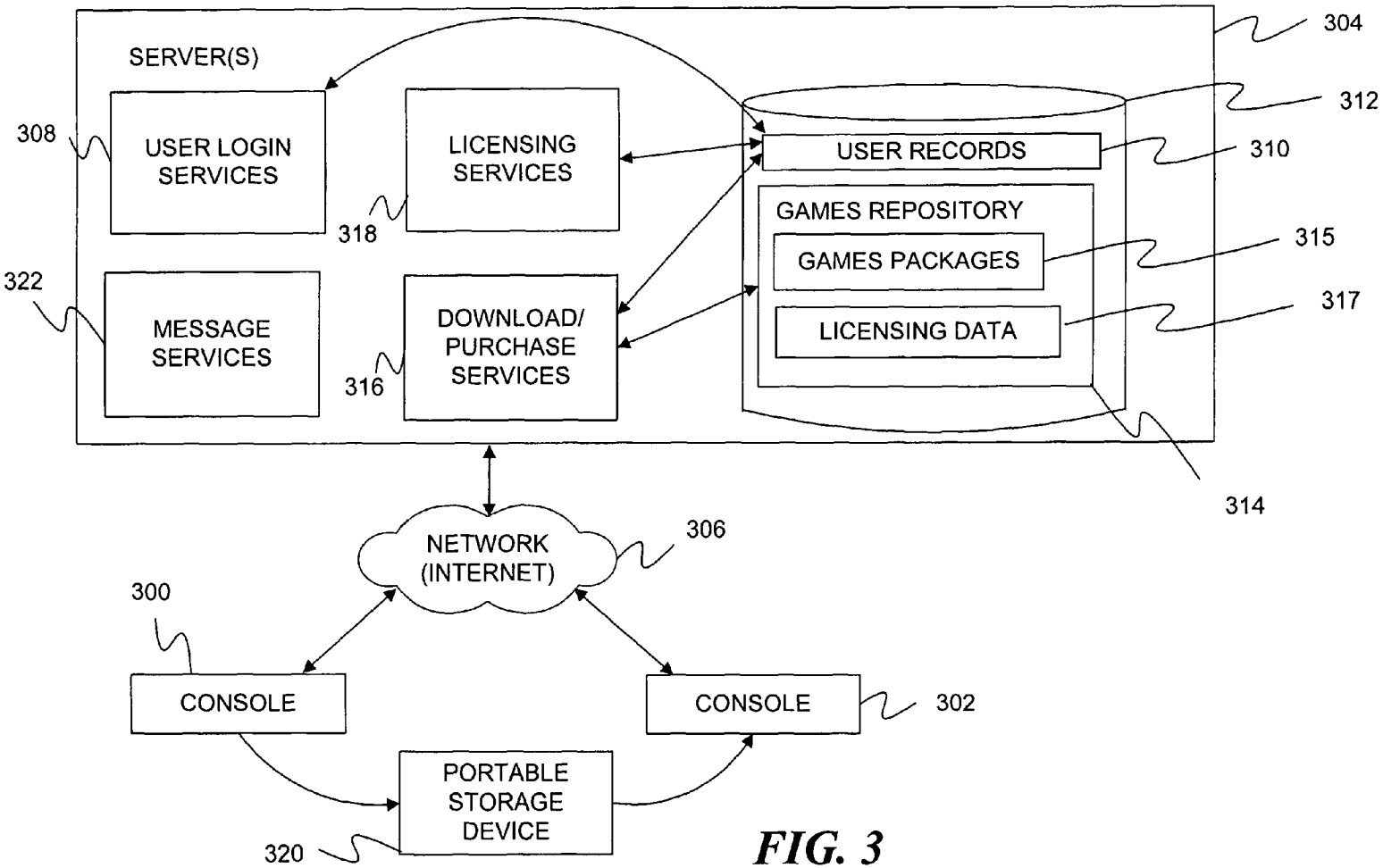
FIG. 3 is a block diagram of consoles networked with one or more servers.

FIG. 3 provides a block diagram of multiple consoles 300, 302 networked with one or more servers 304 through a network 306. Under one embodiment, network 306 comprises the Internet. In one implementation, consoles 300 and 302 communicate with servers 304 over a virtual private network (VPN) that utilizes a secure protocol (e.g., secure socket layer "SSL") to communicate encrypted information through the Internet. In another application, consoles 300 and 302 communicate with server(s) 304 by making calls to dedicated application program interfaces (APIS) using a secure communication protocol that enables closed-network communication. In general, the communication architecture between consoles 300 and 302 and server(s) 304 excludes other general purpose computing devices from communicating with server(s) 304.

Server(s) 304 provide a collection of services that users and applications running on console 300 and 302 may invoke and utilize. In order to restrict access to the services on server(s) 304 and in order to provide custom services to individual users, many embodiments require the user to login to the server(s) 304 using user login services 308. During login, login services 308 obtain a Gamertag (a unique identifier associated with the user) and a password from the user, as well as a console ID that uniquely identifies the console that the user is using and a network path to the console. The Gamertag and password are authenticated by comparing them to information stored in user records 310 in a database 312, which may be located on the same server as user login services 308 or may be distributed on a different server or a collection of different servers. Once authenticated, user login services stores the console ID and the network path in user records 310 so that messages and downloadable content may be sent to the console.

User records 310 also includes a history of content and licenses that the user has downloaded; financial information about the user including a credit card number associated with the user account; and profile information such as the user's reputation and preferred gaming style. Under some embodiments, user records 310 also include an account balance of redeemable points, which can be used to purchase content from server(s) 304. Such points can be accumulated by purchasing them using a credit card or redeeming a pre-paid points card. In general, one dollar purchases a large number of points, thereby allowing micro-pricing for content. For example, $20 USD may purchase 1600 points.

Content may be purchased from server(s) 304 using download/purchase services 316. Such content can include full games, additional levels, maps, characters, equipment and other items that may be used to expand play in a game. In general, such content is stored in one or more games packages 315, which are found in a games repository 314 along with licensing data 317 for the content. During a purchase, download/purchase services 316 retrieves information about the content including a description of the content and the price of the content from games repository 314. Download/purchase services 316 also retrieves financial information about the user from user records 310 that can be used to facilitate the purchase such the user's account balance. Based on input from the user, download/purchase services 316 can reduce the user's account balance to complete the financial transaction.

When a game or content is purchased, a licensing service 318 is used to generate licensing packages that provide permissions allowing the game or content to be played on the console. Under one embodiment, licensing service 318 generates a user license package and a machine license package with each download. The user license package allows a user logged into server(s) 304 to use the content or game regardless of the console that the user is playing on. The machine license allows any user on a console that received the download from the server(s) 304 to use the game or content. In several embodiments, licensing service 318 includes cryptography elements that allow it to encrypt the licensing packages to prevent access to the licensing package except by the console specified during the purchase. Typically, the licensing package forms part of the downloaded content or game that is stored on a storage device connected to the console. By incorporating the licensing package in the downloaded content, the licensing package will be copied whenever the content is copied. For example, if content is copied from console 300 to memory unit 320 and then copied from memory unit 320 to console 302, the licensing package will be present with the content on console 302.

Server(s) 304 also include message services 322, which permit a user on one console, such as console 300, to send a message to a different user on another console, such as console 302. Such messages can include text messages, voice messages, video messages and specialized text messages known as invites, in which a user on one console invites a user on another console to join them in a multi-console session of a game.

Downloading Content

Figure 4:
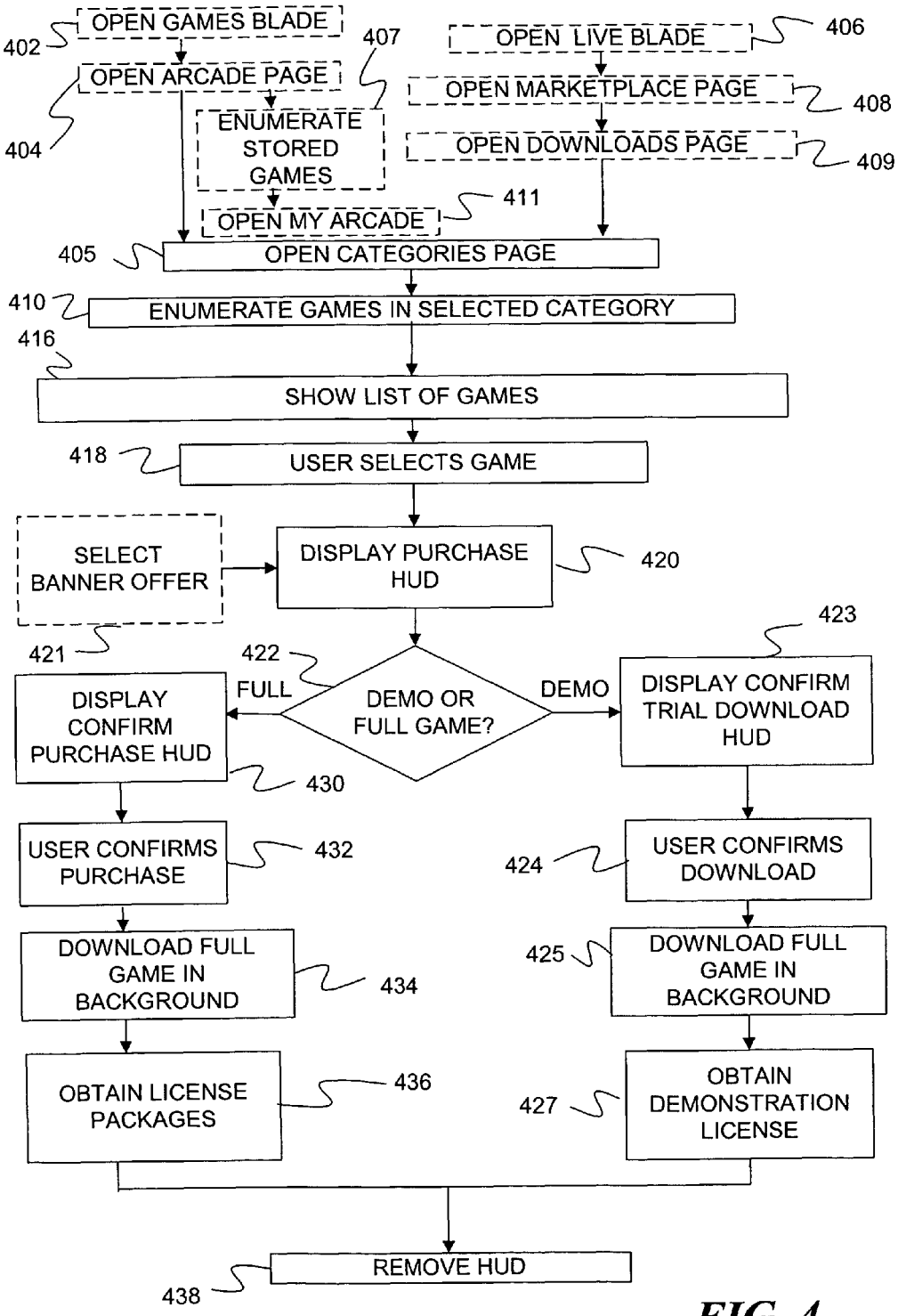
FIG. 4 is a flow diagram for viewing and downloading downloadable games on a server.
Figure 5:
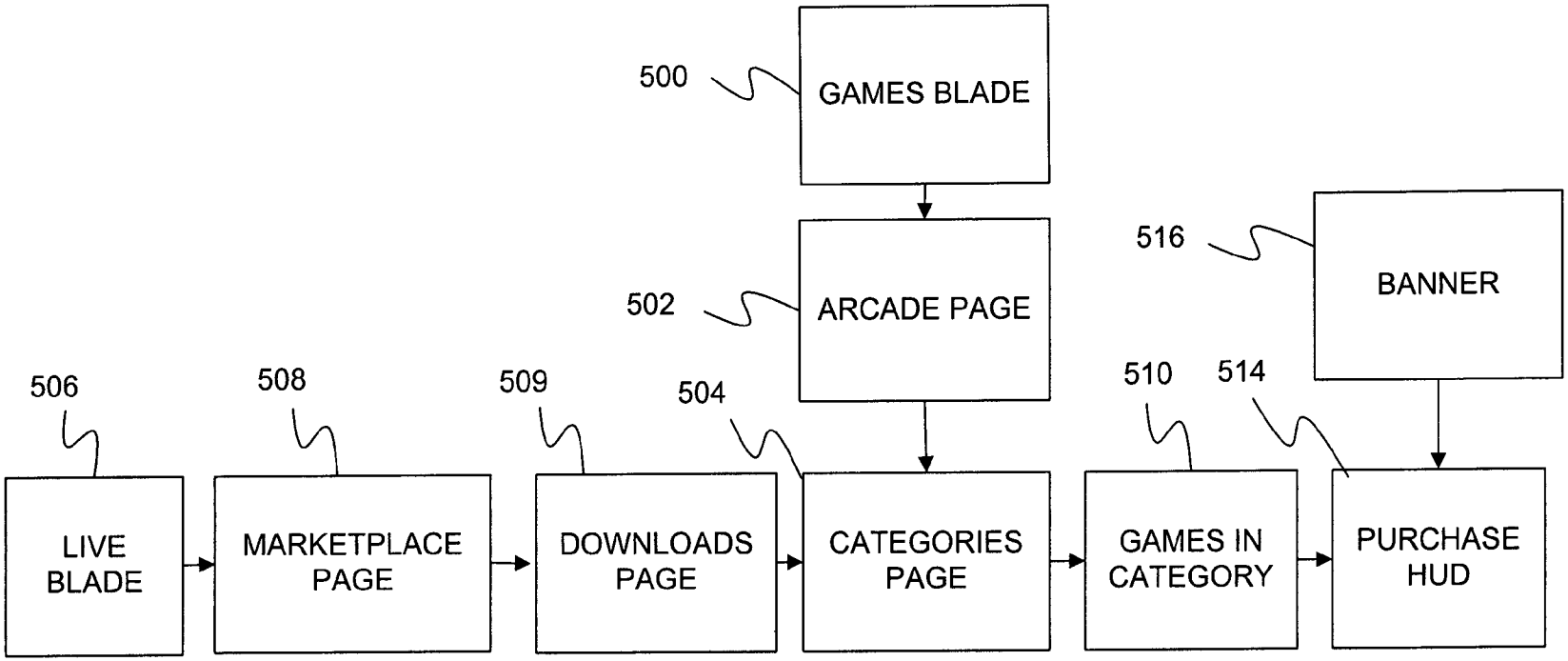
FIG. 5 is a block diagram of page sequences for the flow diagram of FIG. 4.

FIG. 4 provides a flow diagram for downloading content. FIG. 5 provides a sequence of user interfaces that are provided to the user through the flow diagram of FIG. 4. In FIGS. 4 and 5, there are different user interface sequences that can be provided to the user to allow them to download demonstration versions of games and to purchase full versions of games.

Figure 6:
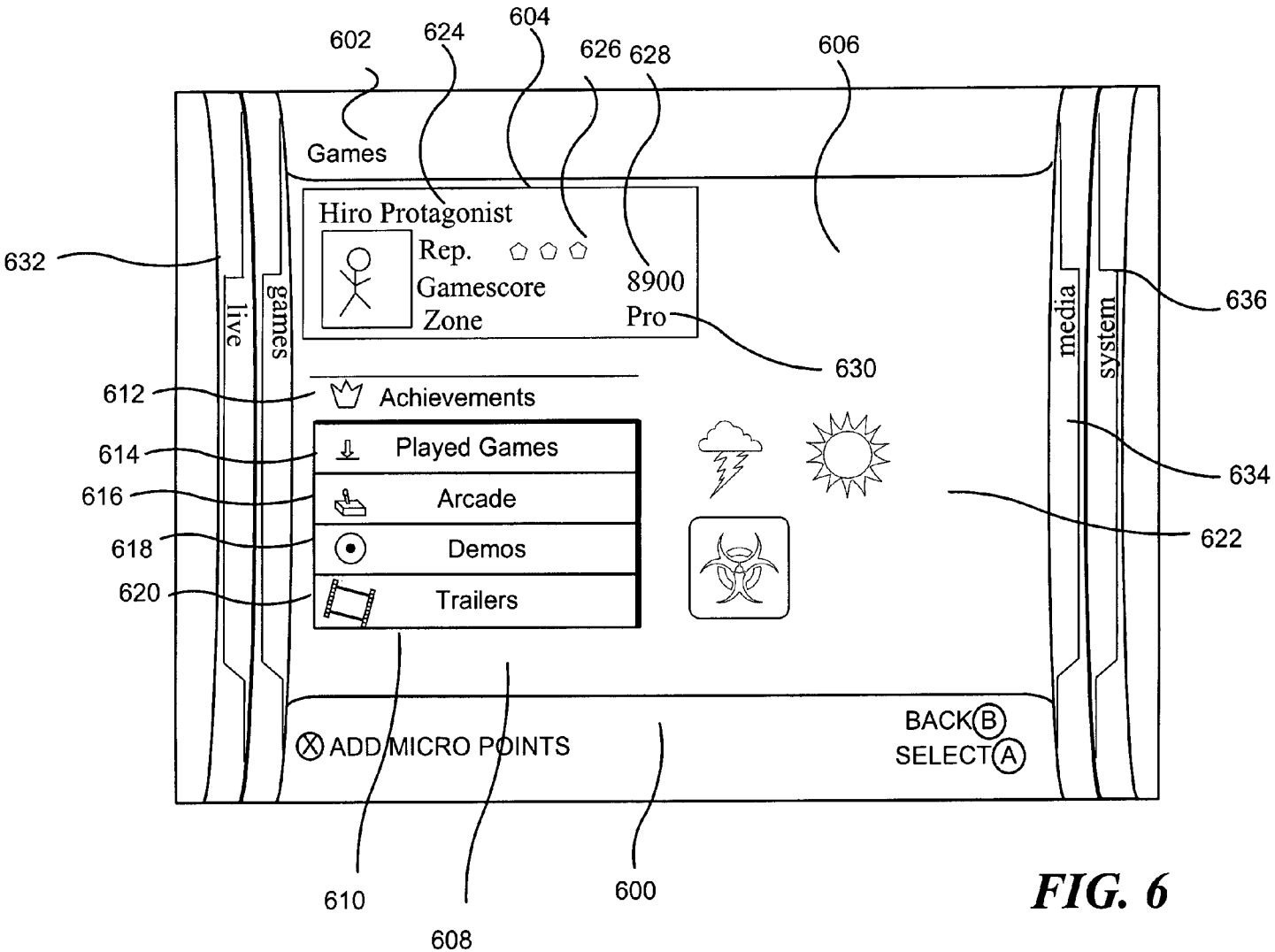
FIG. 6 is a user interface of a Games Blade.

In one embodiment of FIG. 4, a Games blade user interface 500 is opened at step 402. FIG. 6 provides an example of a Games blade user interface. In FIG. 6, Games blade 600 is shown to contain a title 602, a gamer card 604, a banner area 606, a banner area 608 and a menu listing 610 consisting of achievements 612, played games 614, arcade 616, demos 618 and trailers 620. Elements in list 610 may be highlighted using a gamer controller. When an element is highlighted, icons and text relative to the highlighted item appear in area 622. For example, in FIG. 6, the achievements element 612 is highlighted resulting in icons being displayed in area 622 that represent different achievements that the user has acquired for games they have played.

Gamer card 604 includes information about the current user. This information includes the current user's Gamertag 624, their reputation 626, their Gamerscore 628 and their preferred zone of play 630.

The user interface of FIG. 6 also provides tabs 632, 634 and 636, which can be used to bring up a Live blade, a Media blade and a System blade, respectively. The Live blade is discussed below. The Media blade allows the user to interact with different forms of media that may be attached to the console or stored on the hard disc drive of the console. The System blade provides user interfaces that allow the user to set preferences and system parameters such as the time-zone of the console.

From Games blade 500, the user can open arcade page 502 at step 404 by selecting arcade element 616 in list 610. An example of the arcade page is shown in FIG. 7.

Figure 7:
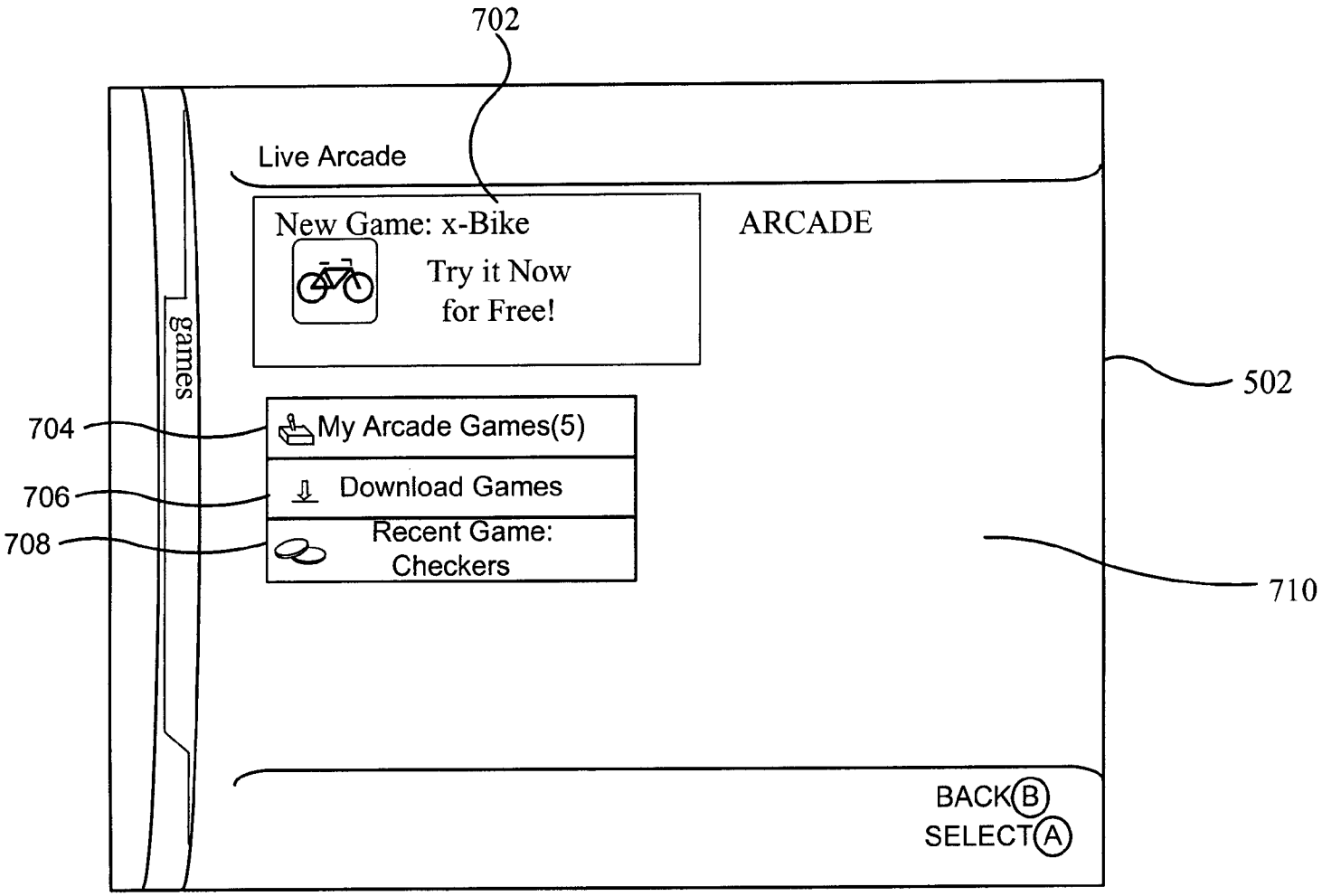
FIG. 7 is a user interface of an Arcade Blade.

In FIG. 7, the arcade page 502 is shown on the games blade and includes a banner area 702, a My Arcade Games selectable menu item 704, a Download Games selectable menu item 706 and a Recent Game selectable menu item 708. The selectable menu items 704, 706 and 708 may be highlighted using the game controller. When a menu item is highlighted, a description of the item is shown in description area 710. Banner 702 can contain advertisements for games that can be downloaded, including free demos of games as shown in FIG. 7 where the x-Bike is advertised for download.

Menu item 704, when selected, provides access to a My Arcade page (discussed in FIG. 16 below) which lists the demonstration games and full version games that are stored on the console. Specifically, if menu item 704 is selected, the storage devices connected to the console are searched to enumerate all games stored on the console at step 407. The enumerated games are then displayed in the My Arcade of FIG. 16 at step 411. When menu item 706 is selected, the user is provided access to a list of games that can be downloaded to the console (As discussed further below). Thus, from the user interface of FIG. 7, the user is provided with two selectable menu items, one that indicates the ability to view games that are stored on at least one storage device in the console and another that indicates the ability to download games to the console.

Note that the user interface of FIG. 7 is not stored on an optical disc, but instead is stored either on the hard disc drive 208 or ROM 204. As a result, the user does not have to insert a disc in order to see the games stored on the console or to view games that can be downloaded to the console.

As noted above, selecting Download Games menu item 706, provides access to games that can be downloaded to the console. Under the embodiment, this access is provided by first displaying a categories page user interface 504 of FIG. 5 that lists categories of games that can be downloaded.

Figure 8:
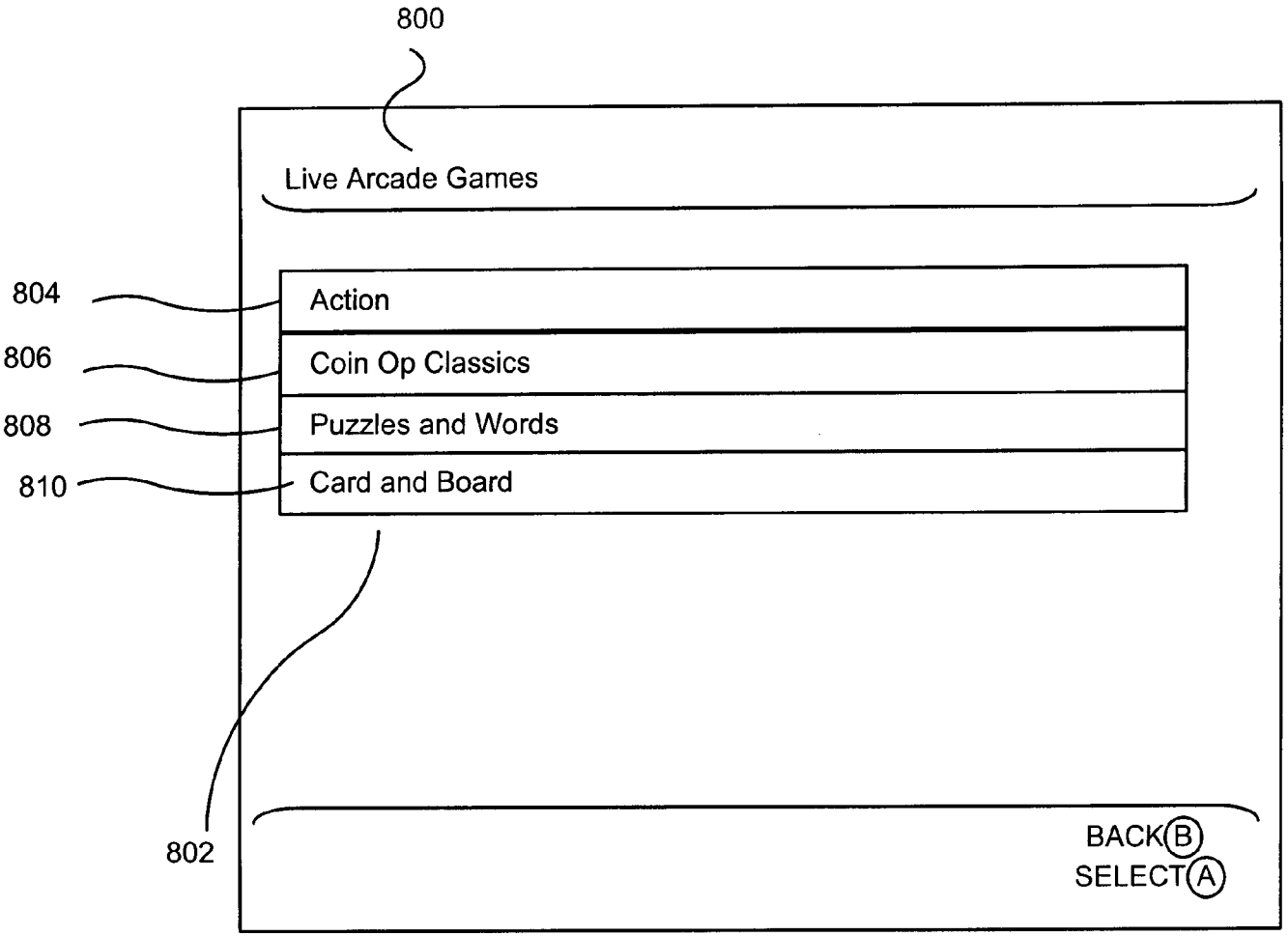
FIG. 8 is a user interface of categories of games.

FIG. 8 provides an example of categories page 504. In FIG. 8, categories page 504 includes a title 800 and a list of categories 802, which includes selectable categories 804, 806, 808, and 810. Those skilled in the art will recognize that the listed categories are exemplary and that different or additional categories may be used.

Categories page 504 may alternatively be displayed by navigating through a series of user interfaces beginning with Live blade 506 which is opened in FIG. 4 at step 406.

Figure 9:
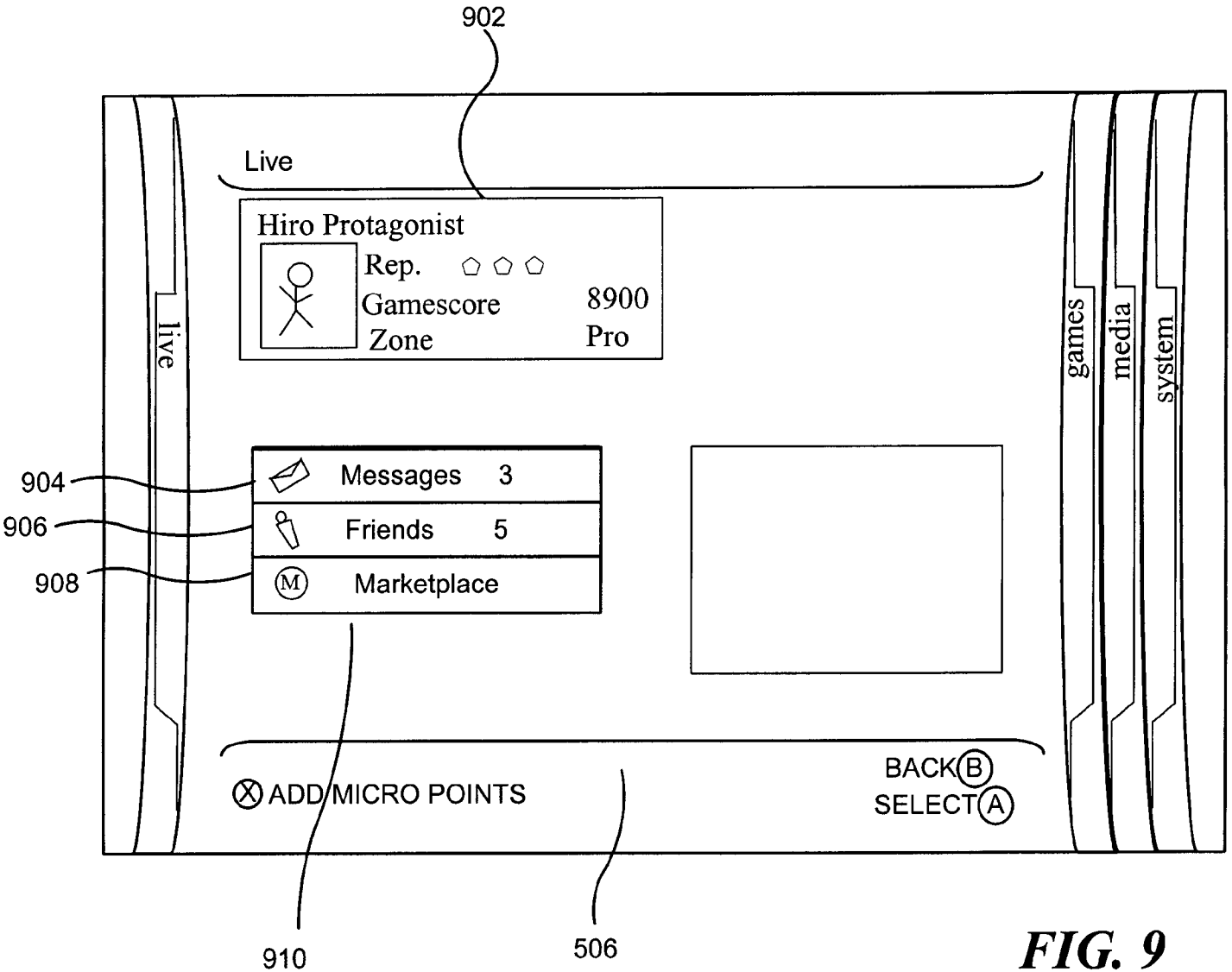
FIG. 9 is a user interface of a Live Blade.

FIG. 9 provides an example of Live blade user interface 506. In FIG. 9, the Live blade user interface includes a gamer card 902, a message menu item 904, a friends menu item 906, a marketplace menu item 908 and a banner area 910. By selecting marketplace menu item 908, the user is able to open a marketplace page 508 at step 408 of FIG. 4.

Figure 10:
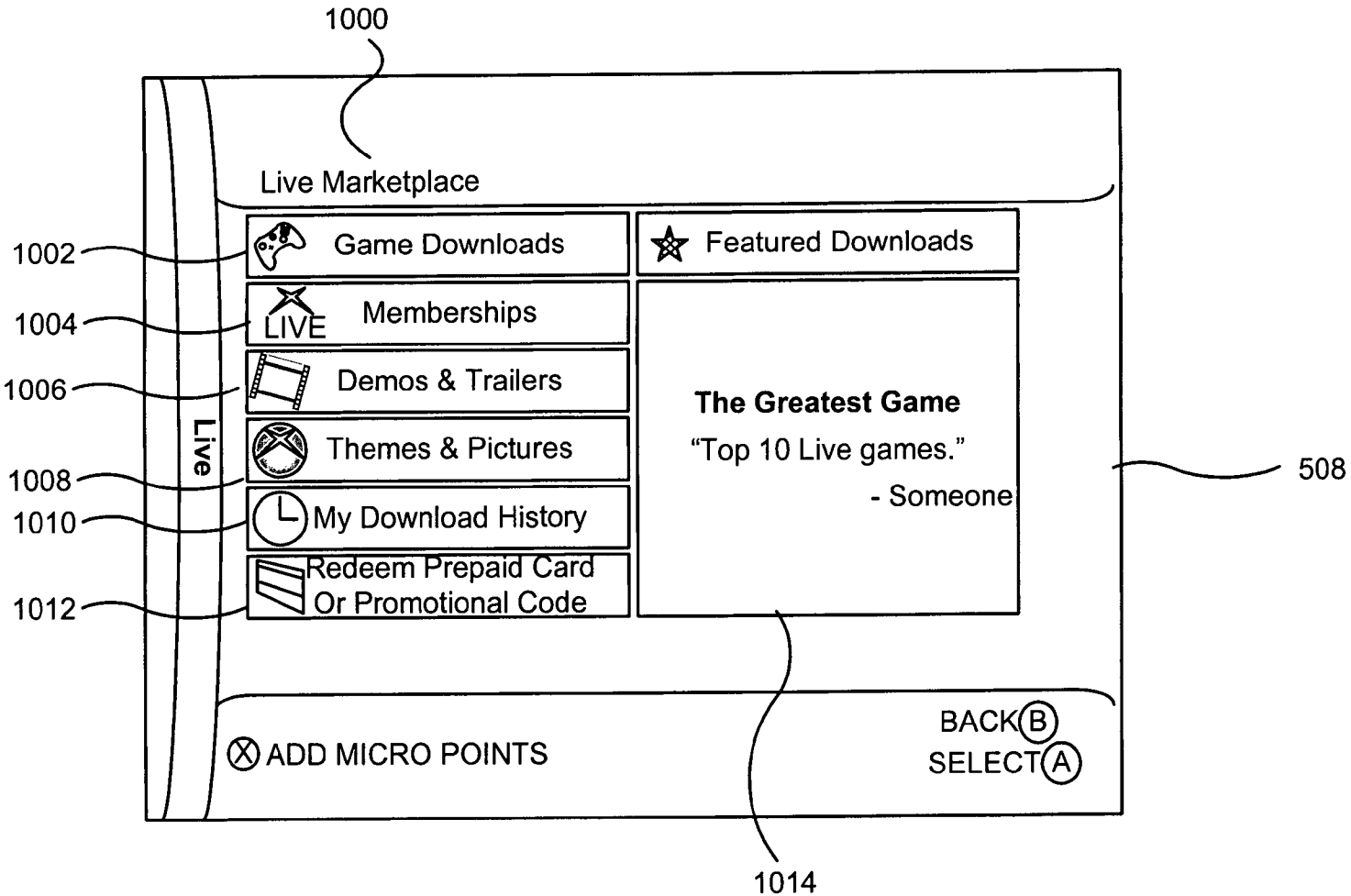
FIG. 10 is a user interface of a Marketplace Blade.

FIG. 10 provides an example of a marketplace page user interface 508. Marketplace page 508 includes a title 1000, game downloads menu item 1002, memberships menu item 1004, demos and trailers menu item 1006, themes menu item 1008, download history menu item 1010, redeem card menu item 1012, and banner area 1014. The user may highlight or select any of the menu items 1002 through 1012 using their controller. Banner area 1014 is used to display advertisements for games, game content, and other downloadable content. By selecting game downloads menu item 1002, the user is able to open a downloads user interface page 509 at step 409.

Figure 11:
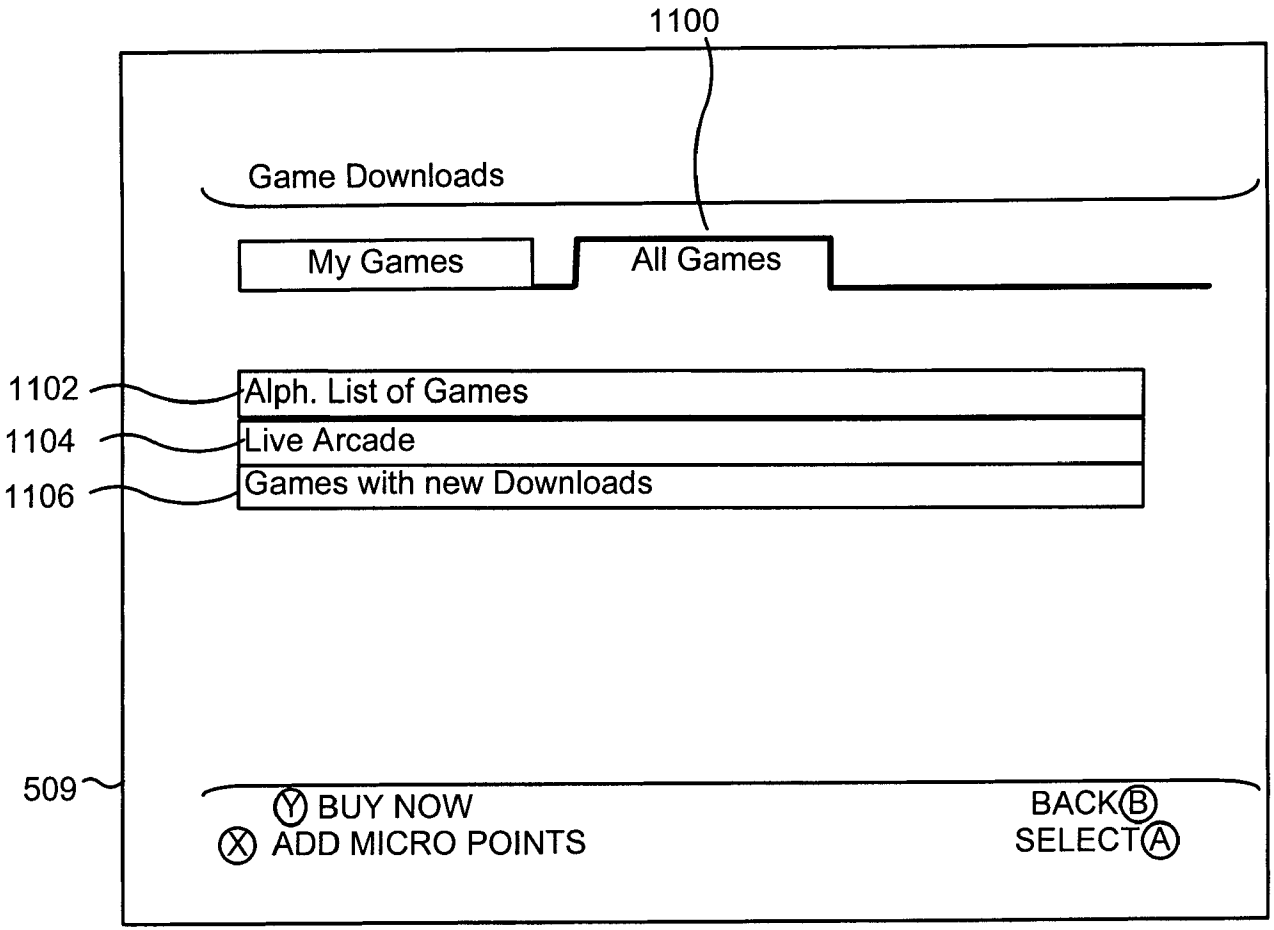
FIG. 11 is a user interface of a downloads page.

FIG. 11 provides an example of downloads user interface page 509. In FIG. 11, page 509 includes a selectable All Games tab 1100, which contains a list of selectable menu items that include Alphabetical listing item 1102, Live Arcade item 1104, and Games with New Downloads item 1106. By selecting Live Arcade item 1104, the user is able to view categories page 504 of FIG. 8 at step 405.

When a user selects a category item from category list 802 in FIG. 8, download services 316 on server 304 enumerates the games that are available on the server in that category by searching through the games database 314 on database 312 at step 410. Download services 316 returns the list of available games to the console. At step 416, the console displays a list of downloadable games in a user interface 510.

Figure 12:
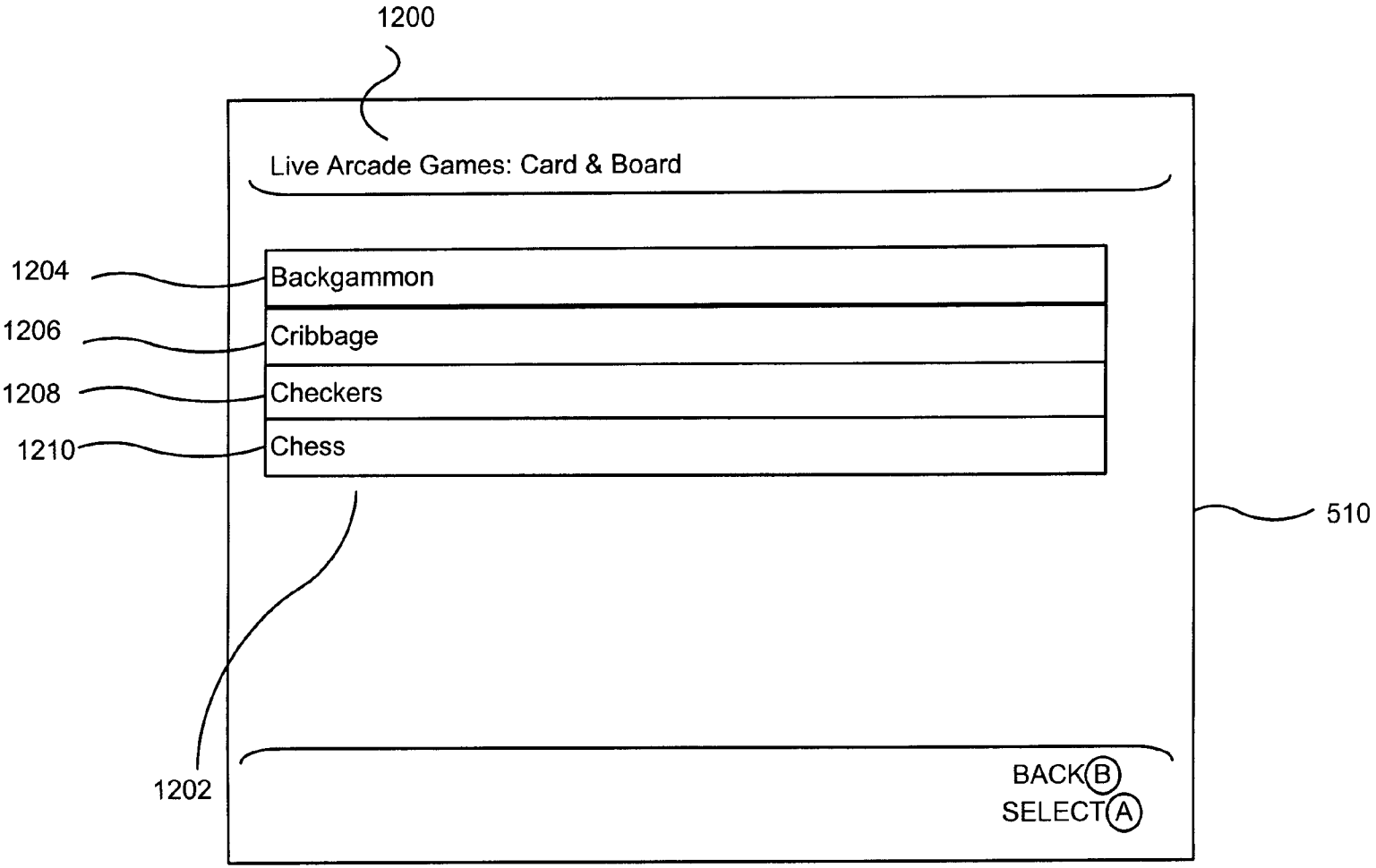
FIG. 12 is a user interface of downloadable arcade games.

FIG. 12 shows an example of user interface 510, which lists games that may be downloaded. The user interface of FIG. 12 includes a title 1200, indicating the category of games, and a listing of games 1202 consisting of selectable games 1204, 1206, 1208 and 1210.

At step 418, the user selects a game from list 1202. In response, an initial purchase Heads Up Display (HUD) 514 is displayed at step 420. The purchase HUD will also be shown if the user selects a banner offer 516 associated with a game at step 421. Such banner offers will appear in one or more of the banner areas noted in the user interfaces above.

Figure 13:
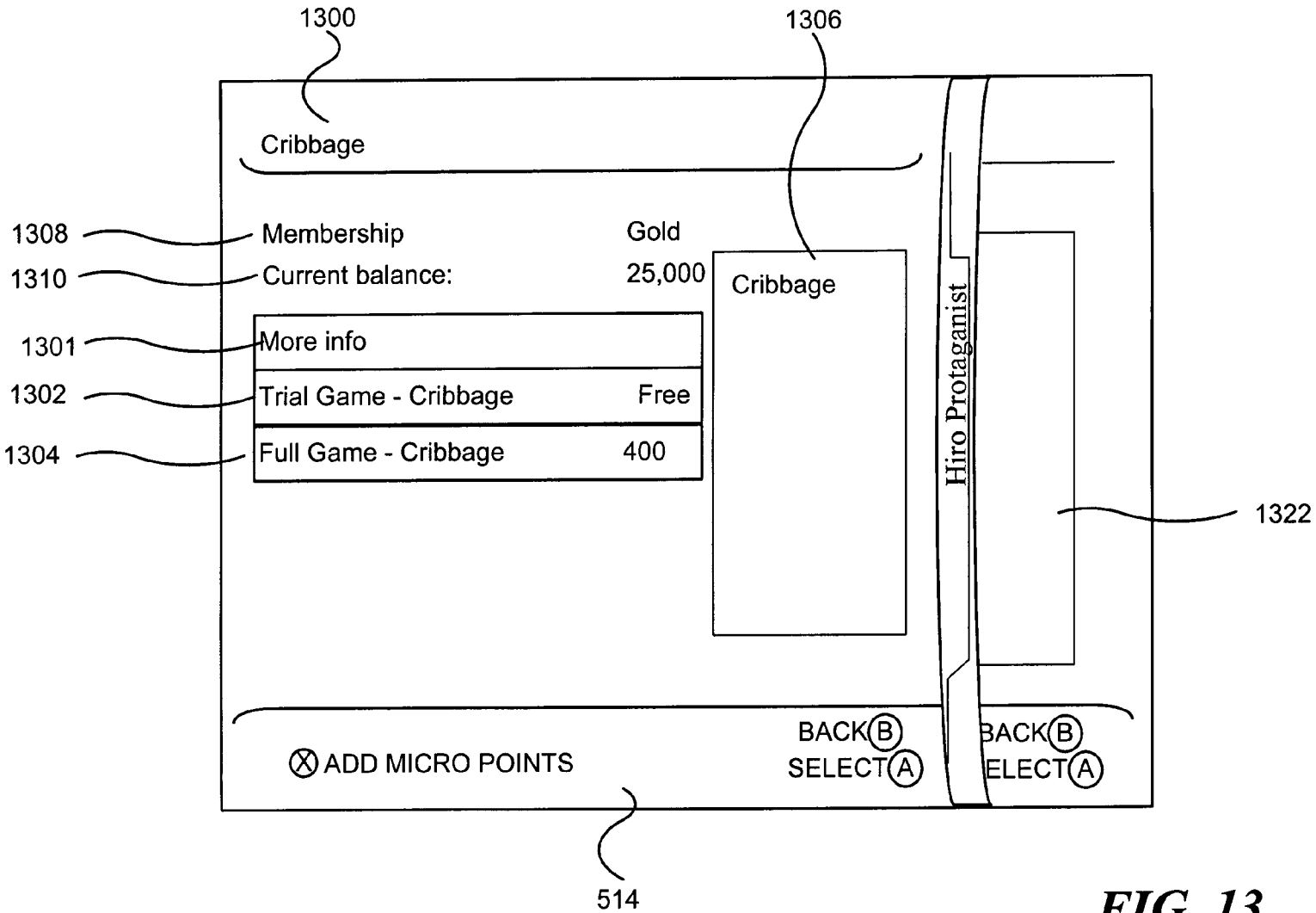
FIG. 13 is an initial Purchase HUD user interface of a selected game.

FIG. 13 provides an example of an initial purchase HUD 514. Under one embodiment, the purchase HUD 514 is not displayed as a page, but instead appears through a graphical animation to extend out from the left side of the display to cover a portion of the current content of the display. The portion 1322 of the current content that is not covered by the HUD appears darkened relative to the HUD.

In FIG. 13, the user interface includes a game title 1300, more information menu item 1301, a Trial Game menu item 1302 and a Full Game menu item 1304. Trial game menu item 1302 indicates that the trial game is free and Full Game menu item 1304 indicates that the full version of the game will cost 400 points. A description of the game appears in description area 1306, which can include the size of the game. A membership level 1308 for the user and a current account balance 1310 are also displayed.

Figures 1, 14:
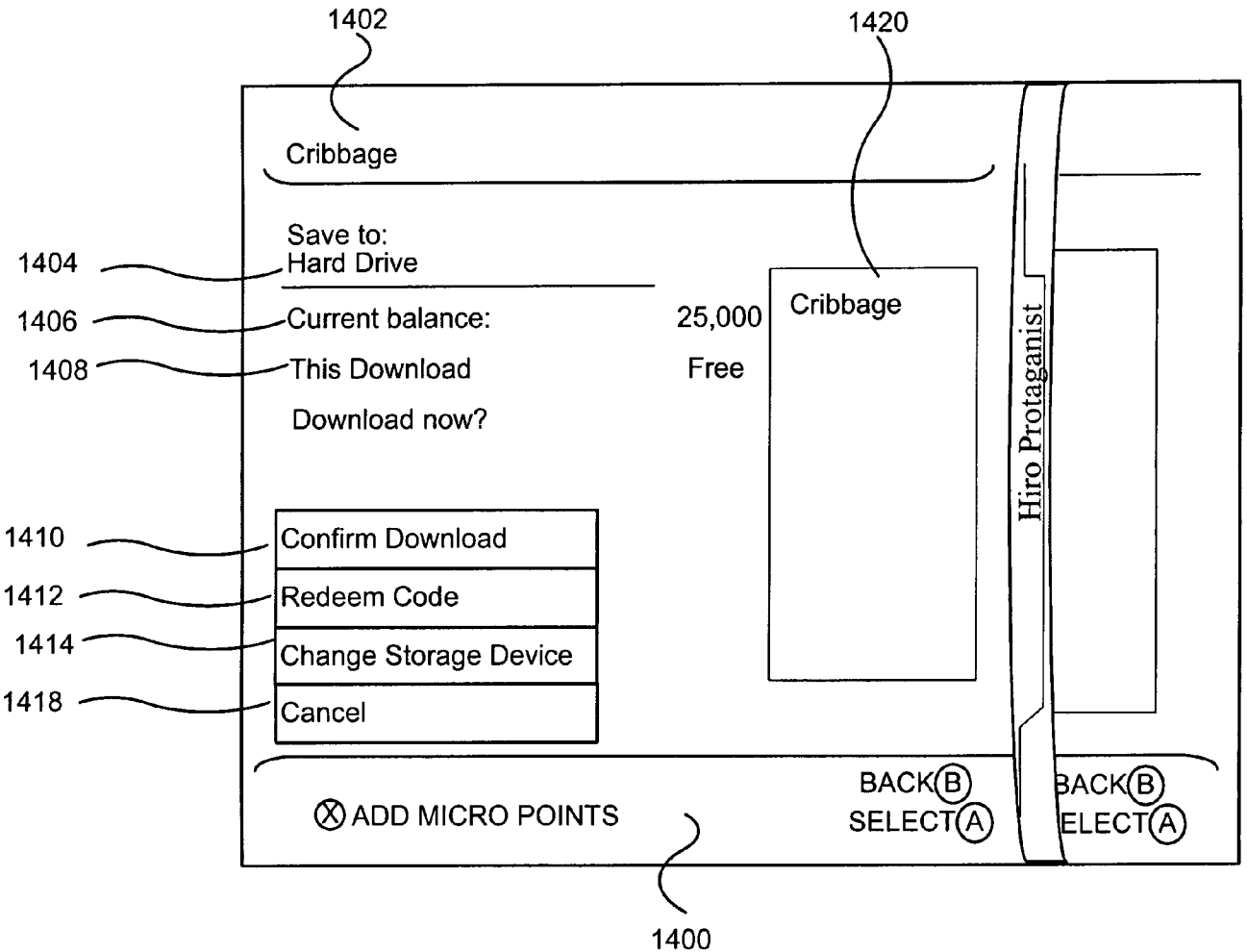
Figures 2, 14:
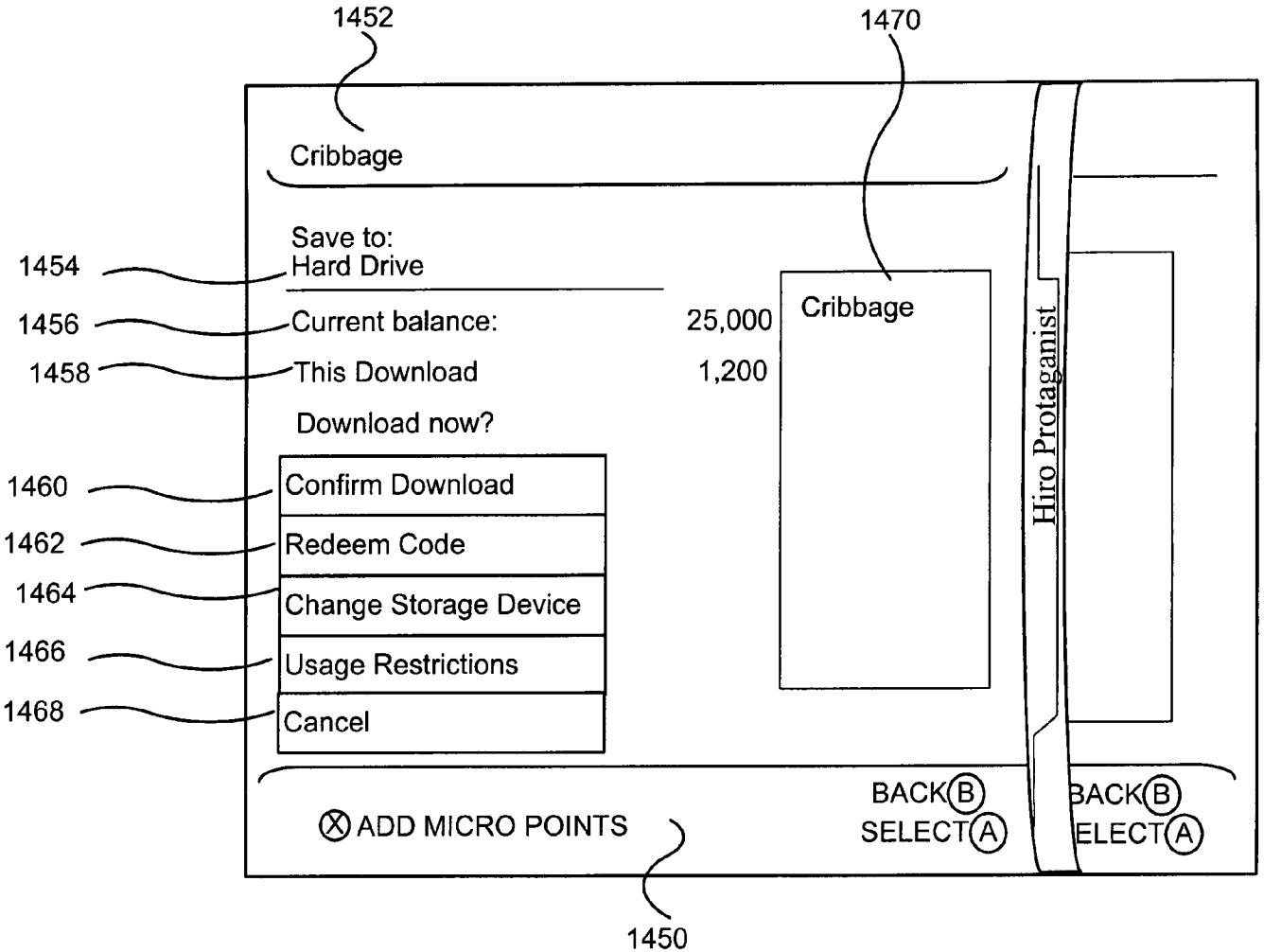

If the user selects Trial Game menu item 1302 at step 422, a confirm trial game download HUD is displayed at step 423. FIG. 14-1 provides an example of a confirm trial download HUD 1400.

In confirm trial download HUD 1400, a title 1402 is provided that indicates the title of the game that is being purchased, "Save To:" area 1404 indicates the storage device that the game will be stored to on the console and Current Balance 1406 indicates the number of points the user has in their account. This Download item 1408 indicates that the download is free. HUD 1400 also includes a Confirm Download menu item 1410, a Redeem Code menu item 1412, a Change Storage Device menu item 1414, and a Cancel menu item 1418. Change Storage Device menu item 1414 can be selected to change which storage device the game is saved to. Cancel menu item 1418 cancels the purchase. The user interface of FIG. 14-1 also includes a description area 1420 that describes the size of the game and the contents of the game.

If the user selects confirm download menu item 1410 at step 424, the full version of the game is downloaded at step 425 and a demonstration licensing package for the game is downloaded at step 427. Note that in some embodiments, the full version of the game and the demonstration licensing package are downloaded as a single item. The demonstration licensing package limits play in the game to a demonstration version of the game. As a result, when the game is started, the game will determine that there are insufficient permissions to allow the full version of the game to operate, and only the demonstration version of the game will run. By downloading the full version of the game even though the user has only requested the demonstration version, this embodiment makes it quicker and easier for the user to upgrade to an expanded version of the game at a later date.

Under some embodiments, the download of the full version of the game and the demonstration licensing package is done in the background so that the user may continue to use the console for other purposes while the download is being completed.

If the user selects item 1304 of FIG. 13 to download the full version of the game at step 422 a confirm purchase HUD is shown at step 430.

FIG. 14-2 provides an example of a confirm purchase HUD 1450. In the confirm purchase HUD of FIG. 14-2, a title 1452 is provided that indicates the title of the game that is being purchased, Save To: area 1454 indicates the storage device that the game will be stored to on the console and Current Balance 1456 indicates the number of points the user has in their account. This Download item 1458 indicates the number of points that will be taken from the account if the user confirms the download. The user interface of FIG. 14-2 also includes a Confirm Download menu item 1460, a Redeem Code menu item 1462, a Change Storage Device menu item 1464, a Usage Restriction menu item 1466 and a Cancel menu item 1468. The Redeem Code menu item 1462 can be selected by the user to redeem a code that allows the download to be received at a discounted price or for free. Change Storage Device menu item 1464 can be selected to change which storage device the game is saved to. Usage Restriction menu item 1466 can be selected to set permissions that are used during game play. This allows parents to set restrictions on use of the game. Cancel menu item 1468 cancels the purchase. The user interface of FIG. 14-2 also includes a description area 1470 that describes the size of the game and the contents of the game.

When the user selects Confirm Download menu item 1460 at step 432, console 300 calls download/purchase services 316 to deduct the points for the game from the user's account and request the content package for the game, if the game has not previously been downloaded, at step 434. At step 436, licenses are obtained for the game using the licensing services 318.

Obtaining a License

Figure 15:
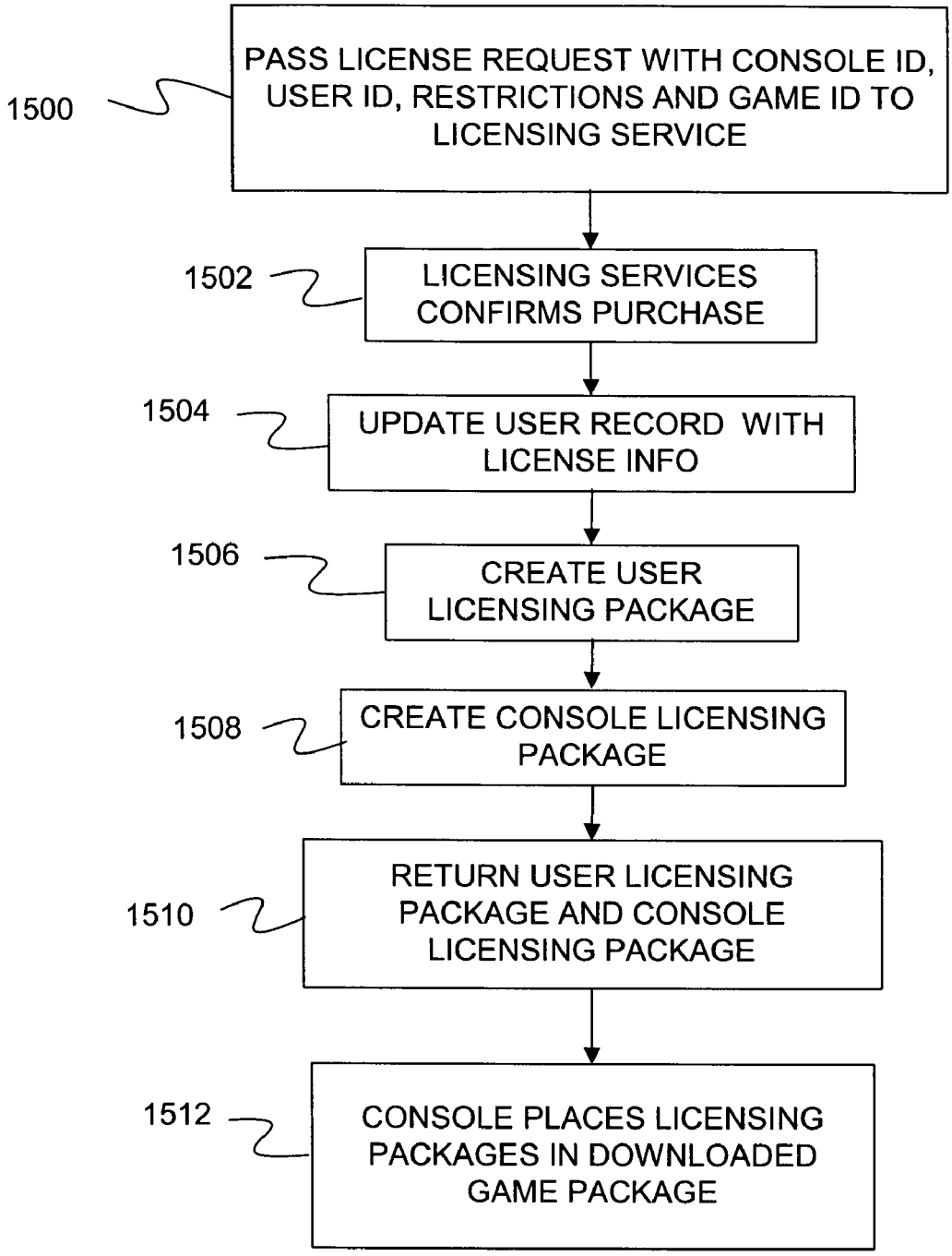
FIG. 15 is a flow diagram for obtaining a license.

FIG. 15 provides a flow diagram of steps involved in obtaining a license. In step 1500 of FIG. 15, a console ID, a user ID, restrictions and a game title ID are passed to licensing services 318. At step 1502, licensing services 318 confirms that the game has been purchased for the user ID and console ID and at step 1504, licensing services 318 updates the user record on the server with the license info to indicate the permissions assigned to the user ID and the permissions assigned to the console ID for the game title ID. By storing the license information on the server, users are able to download additional copies of the game title without having to purchase the game title again. These additional downloads can be made to the same console, if the game has been deleted from the console, or may be made to other consoles. If the game is downloaded to another console, the licensed user must be logged into server(s) 304 in order for the full version of the game to be used.

At step 1506, licensing service 318 creates the user license package and at step 1508, licensing services 318 creates the console licensing package. The creation of these packages includes encrypting the packages. At step 1510, licensing services 318 returns the user license package and the console license package to the console. At step 1512, the console places the licensing packages in the downloaded game package. Through this placement, the licensing packages will be transferred with the game if the game is later saved to a different memory device.

After the licenses have been obtained and the download is completed after either step 427 or step 436, the HUD is removed at step 438.

Viewing Downloaded Games

Figure 16:
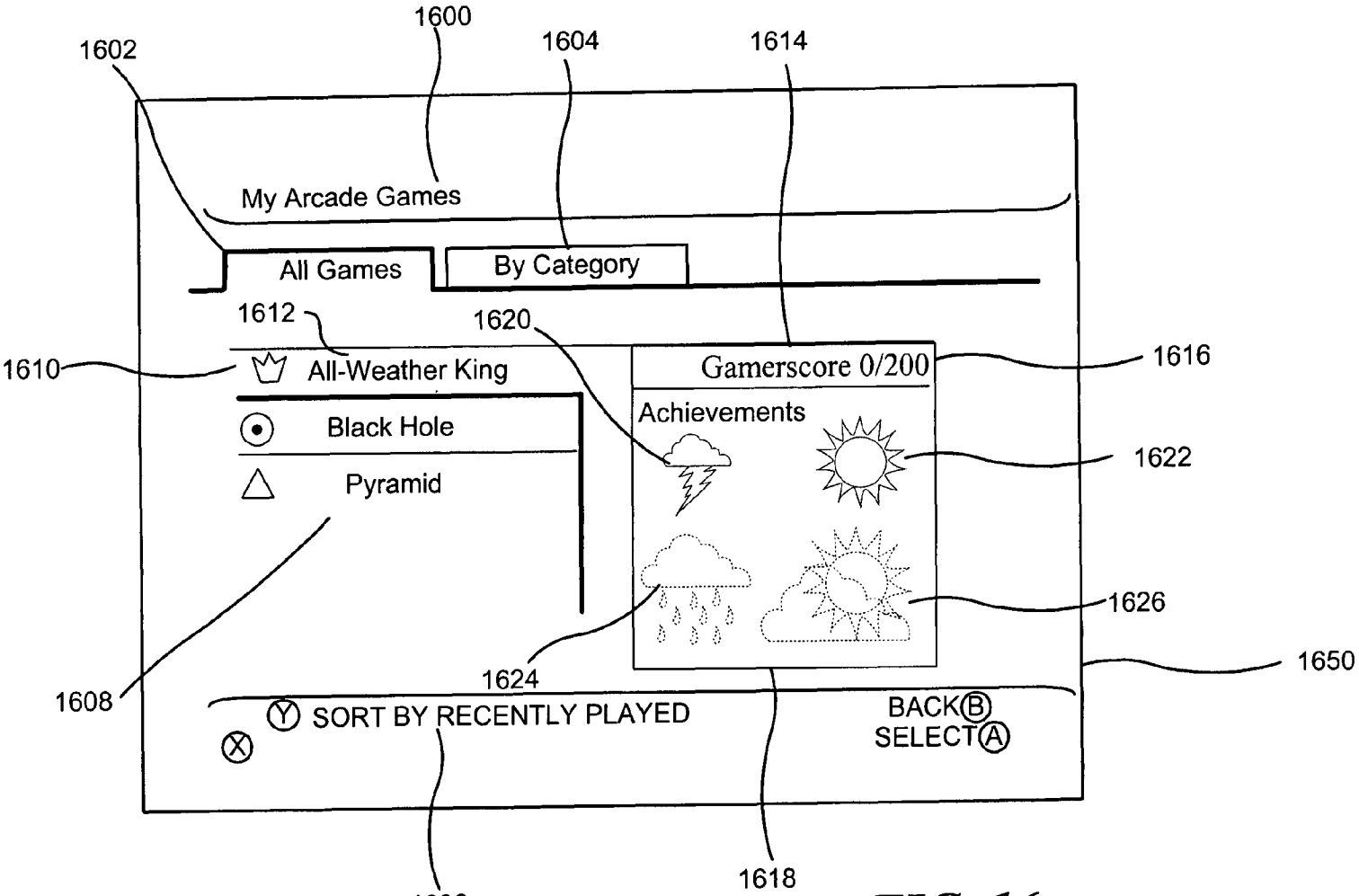
FIG. 16 is a user interface listing games downloaded onto a console.

Once the download is complete, the user may view the downloaded game by selecting My Arcade item 704 of FIG. 7, which will cause the list of downloaded games on the console to be displayed in a My Arcade user interface such as user interface 1650 shown in FIG. 16.

In FIG. 16, the My Arcade user interface includes a title bar 1600, an All Games tab 1602 and a By Category tab 1604. If By Category tab 1604 is selected, games are shown under category headings. Under All Games tab 1602, shown in FIG. 16, games are listed in alphabetical order. Alternatively, the games may be sorted based on when they were last played by pressing the Y button on the controller as indicated by instruction 1606. The All Games tab includes a listing 1608 of games that are stored on the console. Each entry in listing 1608 includes a game icon, such as game icon 1610, and a game title, such as game title 1612. Using the controller, the user is able to highlight a game.

When a game is highlighted, a description area 1614 provides information about the user's performance in the game. In particular, description area 1614 includes a Gamerscore 1616 for the user, and an achievements area 1618 that describes achievements the user has obtained while playing the game. The Gamerscore 1616 indicates the number of Gamerscore points the user can or has earned relative to the number of Gamerscore points that may be earned. In alternative embodiments, description area 1614 provides the high score achieved by the user. An achievement can be any number of items selected by the game developer including number of games won, levels reached, opponents beaten, or the like. In some embodiments, achievements that have not been earned are shown with a dimmed icon while achievements that have been obtained are shown with a bright icon so that it is apparent that some icons have been achieved while others have not. For instance, achievements 1620 and 1622 are shown with a bright icon while achievements 1624 and 1626 are shown with a dimmed icon, depicted in FIG. 16 with dotted lines.

Figure 17:
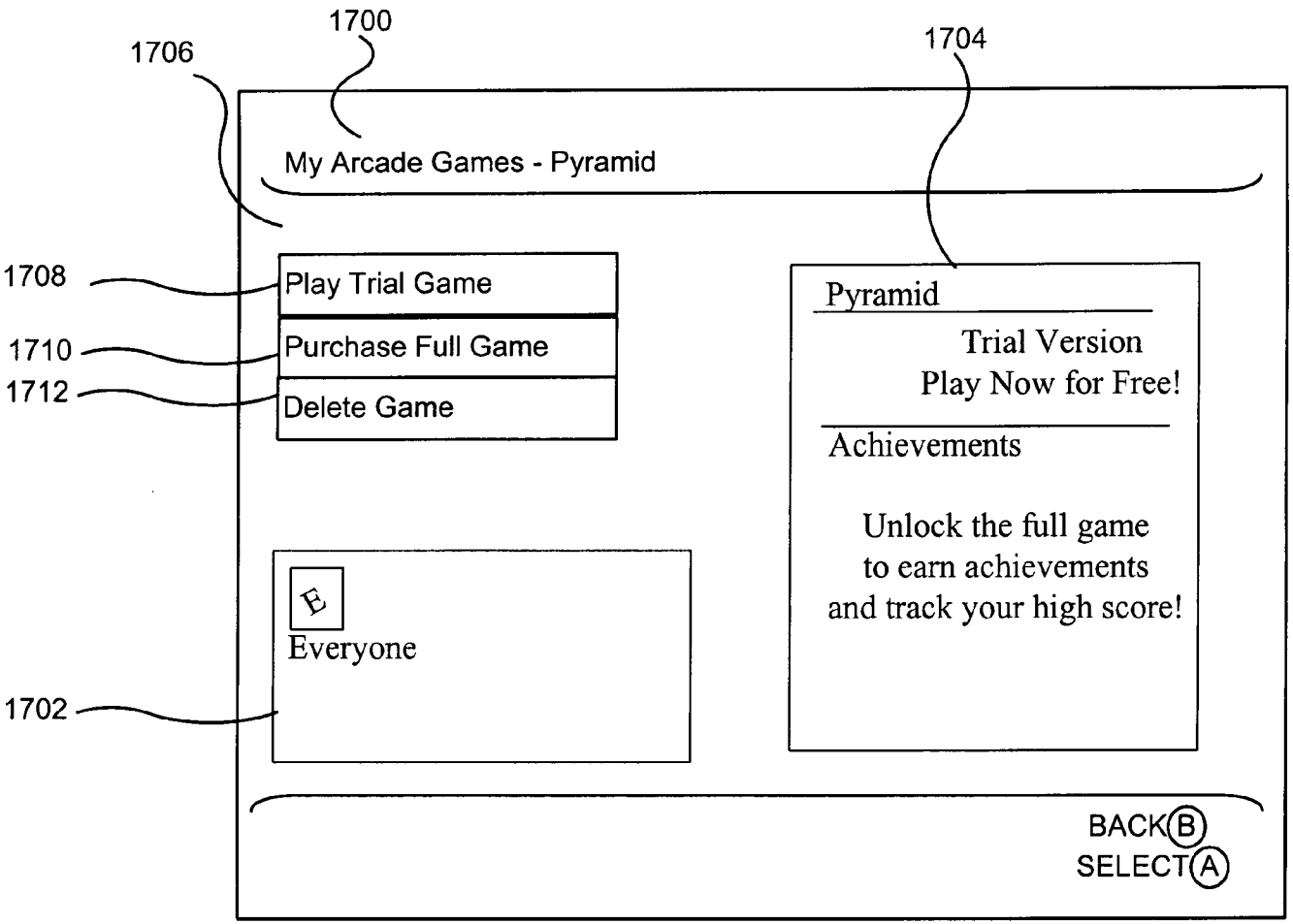
FIG. 17 is a user interface for a selected downloaded trial version game.

As indicated in FIG. 16, by pressing the A button on the controller, the user is able to select a game to view details of the game. FIG. 17 provides a user interface for a selected game that has been downloaded in a demonstration version only. User interface FIG. 17 includes a title bar 1700 that includes the title of the game, a rating area 1702 that includes rating information about the game, and a game description area 1704 that describes the game as being a demonstration version and that indicates that achievements for the game can be earned and recorded if the full game is unlocked or purchased. A menu list 1706 includes a selectable command 1708 for playing the trial (demonstration) game, a selectable command 1710 for unlocking the full version of the game and a selectable command 1712 for deleting the game from the hard drive. If the user selects to play the trial game, the trial version of the game is started. If the user selects to unlock the full game, the purchase HUD of FIG. 14 is brought up over the My Arcades Games page and the user is allowed to purchase the game simply by clicking on confirm download button 1410.

In the user interface of FIG. 17, no achievements are shown for the user since achievements are not available for trial versions of games. This provides incentive to the user to unlock the full version of the game.

Figure 18:
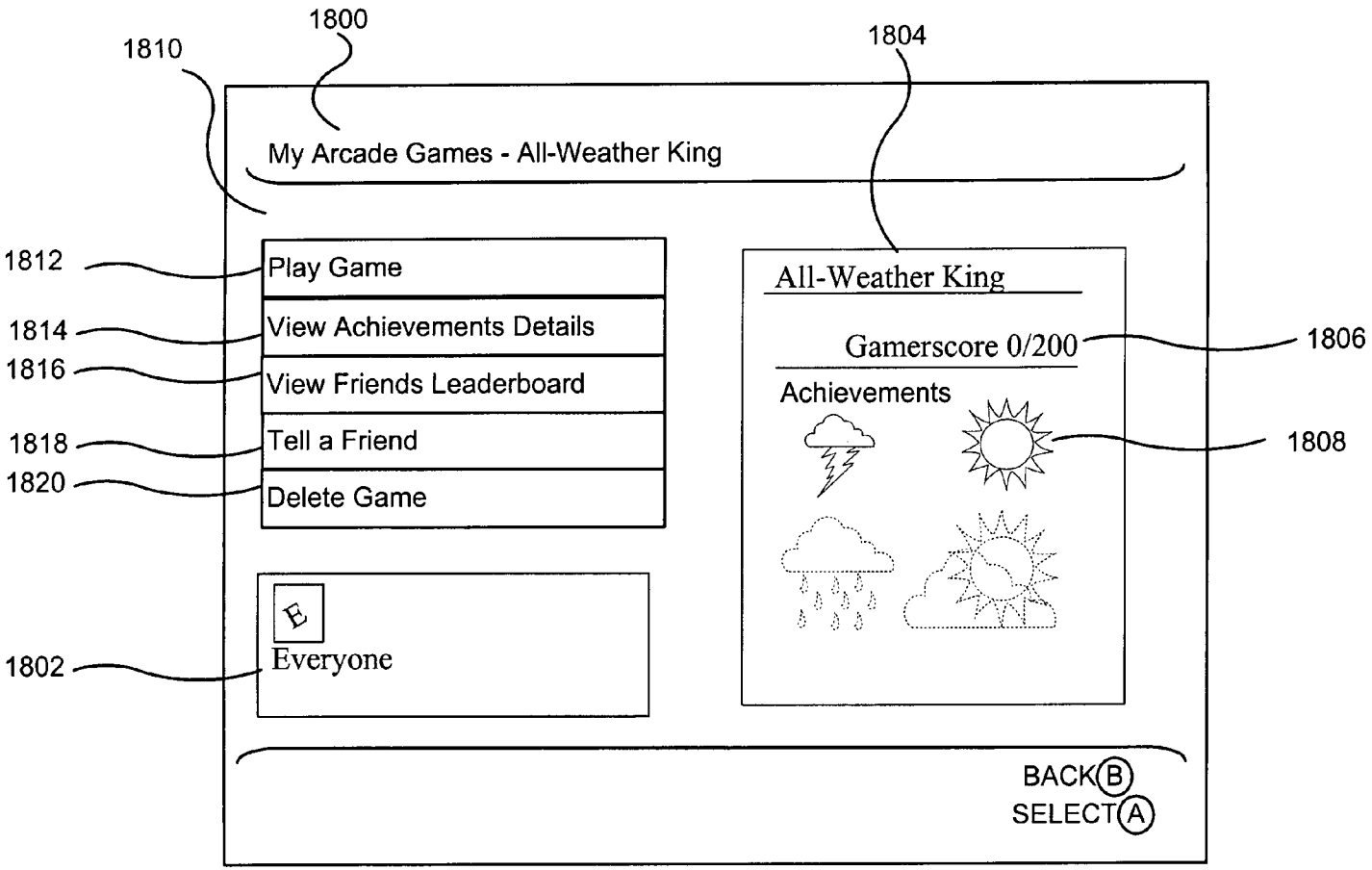
FIG. 18 is a user interface for a selected downloaded full version of a game.

FIG. 18 provides a user interface for a selected game that is licensed as a full version game on the console. The user interface of FIG. 18 includes a title bar 1800 that displays the name of the game, a rating area 1802 that provides rating information for the game and a game information area 1804, which provides a Gamerscore 1806 and a list of achievements earned by the user 1808. In other embodiments, game information area 1804 provides other information about the game such as the user's high score or current level.

The user interface of FIG. 18 also includes a list of selectable commands 1810 that include the Play Game command 1812, the View Achievements Detail command 1814, the View Friend's Leaderboard command 1816, the Tell a Friend command 1818 and the Delete Game command 1820. Using the game controller, the user may highlight and select one of the commands in the list. If the user selects Play Game command 1812, the game is started and the user interface is removed. If the user selects View Achievements Details command 1814, a page showing details about the achievements obtained by the user and achievements that are still left to be obtained by the user is displayed. If the View Friend's Leaderboard command 1816 is selected, a leaderboard is displayed on a new page. In some embodiments, the achievements area is made smaller to accommodate the friend's leaderboard. The friend's leaderboard includes scores for friends of the user who have played this game. Under one embodiment, the list of friends is displayed by displaying each friend sequentially beginning with the highest ranked friend. The leaderboard will include the current user if the user is ranked high enough.

Command 1818 creates a message that can be sent to a friend of the user to tell them about the game. Command 1820 deletes the game from the storage device that it is stored on.

Unlocking Full Versions of Games During Play

Figure 19:
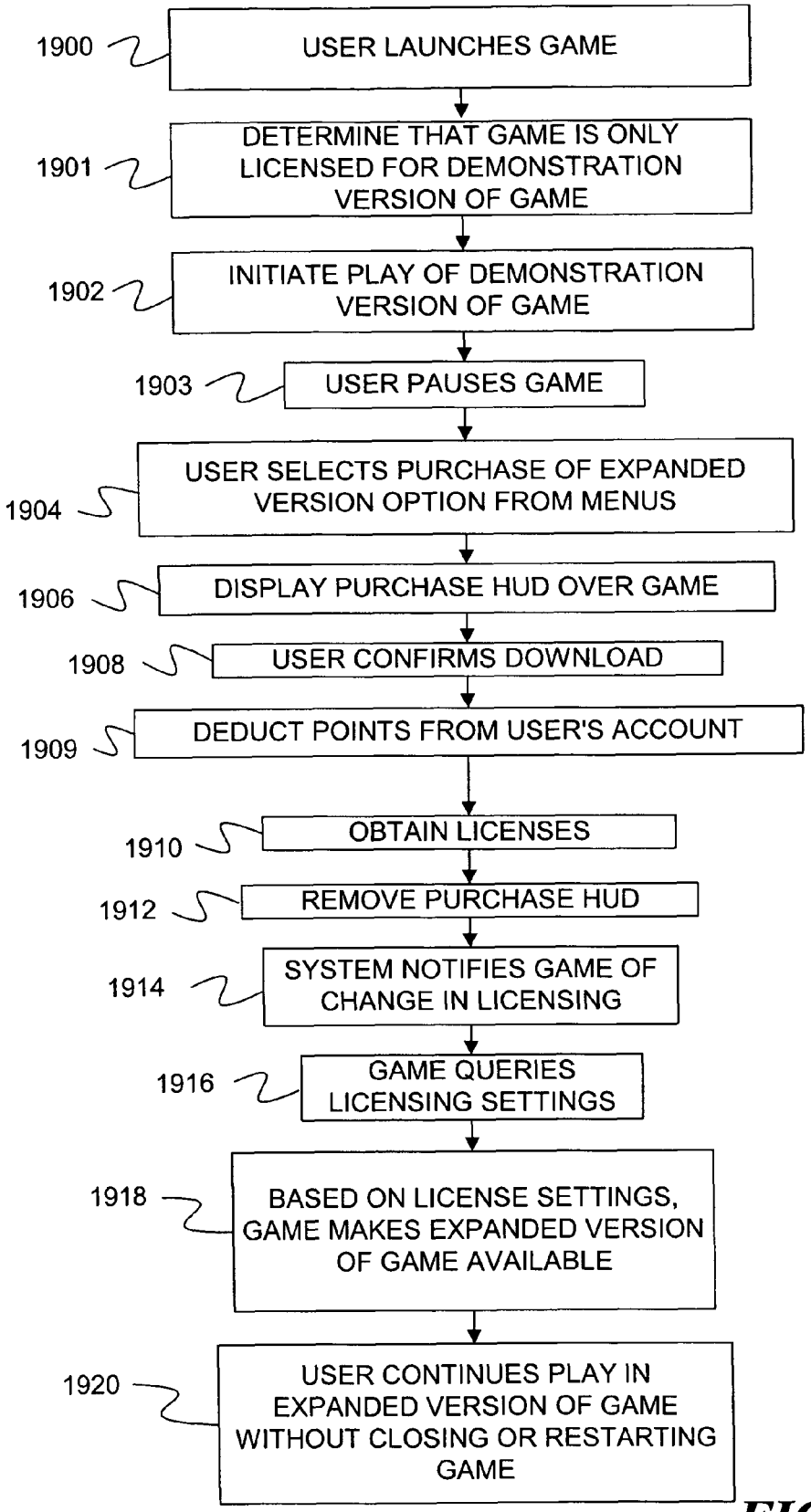
FIG. 19 is a flow diagram for unlocking an aspect of a game during play of the game.

In the user interface of FIG. 17, it was shown that the user can unlock the full game by selecting the unlock full game command on the game details page. In addition, under some embodiments, the user is able to unlock an expanded version of the game while playing the game. FIG. 19 provides a flow diagram for unlocking an expanded version of the game during play of the game.

In step 1900, the user launches the game by indicating that they want to play the game. At step 1901, the game queries its license and determines that game is licensed only as a demonstration version. At step 1902, play is initiated in the demonstration version of the game. At step 1903, the user pauses the game but does not close the game. As a result, the game remains in RAM and cache memory and is considered to still be running.

At step 1904 the user selects a command to purchase an expanded version of the game from a list of menu items. In response, the confirm purchase HUD of FIG. 14-2 is displayed over the game at step 1906. At step 1908, the user confirms the download of the game. In response, the cost of the expanded version is deducted from the user's account at step 1909 and the console obtains the license for the expanded version of the game at step 1910 using the process described in the flow diagram of FIG. 15. In the flow diagram of FIG. 15, licensing packages are downloaded to the console and are stored in the content package of the game. In other embodiments, a message is sent by licensing services 318 to console 300 to alter the existing licensing package stored in the content package of the game so that the altered license provides permissions for playing the expanded version of the game. At step 1912, the purchase HUD is removed and at step 1914, the system notifies the game of a change in licensing. The game then queries for the license settings for the game at step 1916 using an application programming interface provided by the system. Based on the licensed settings, the game makes an expanded version of itself available to the user at step 1918. The user then continues play in the expanded version of the game at step 1920 without having to close, stop, or restart the game. Under some embodiments, play resumes at the same point in the game where the user paused the game. Thus, the expanded version of the game becomes available to the user without having to leave the existing game they are playing.

In the description above, references have been made to obtaining an expanded version of a game. This may include obtaining the full version of the game or just incremental expansions of the game. Examples of possible game expansions include such things as additional levels, maps, characters, or equipment. Thus, the user may incrementally expand the game during play.

Driving Game Purchases Through Copied Games

Figure 20:
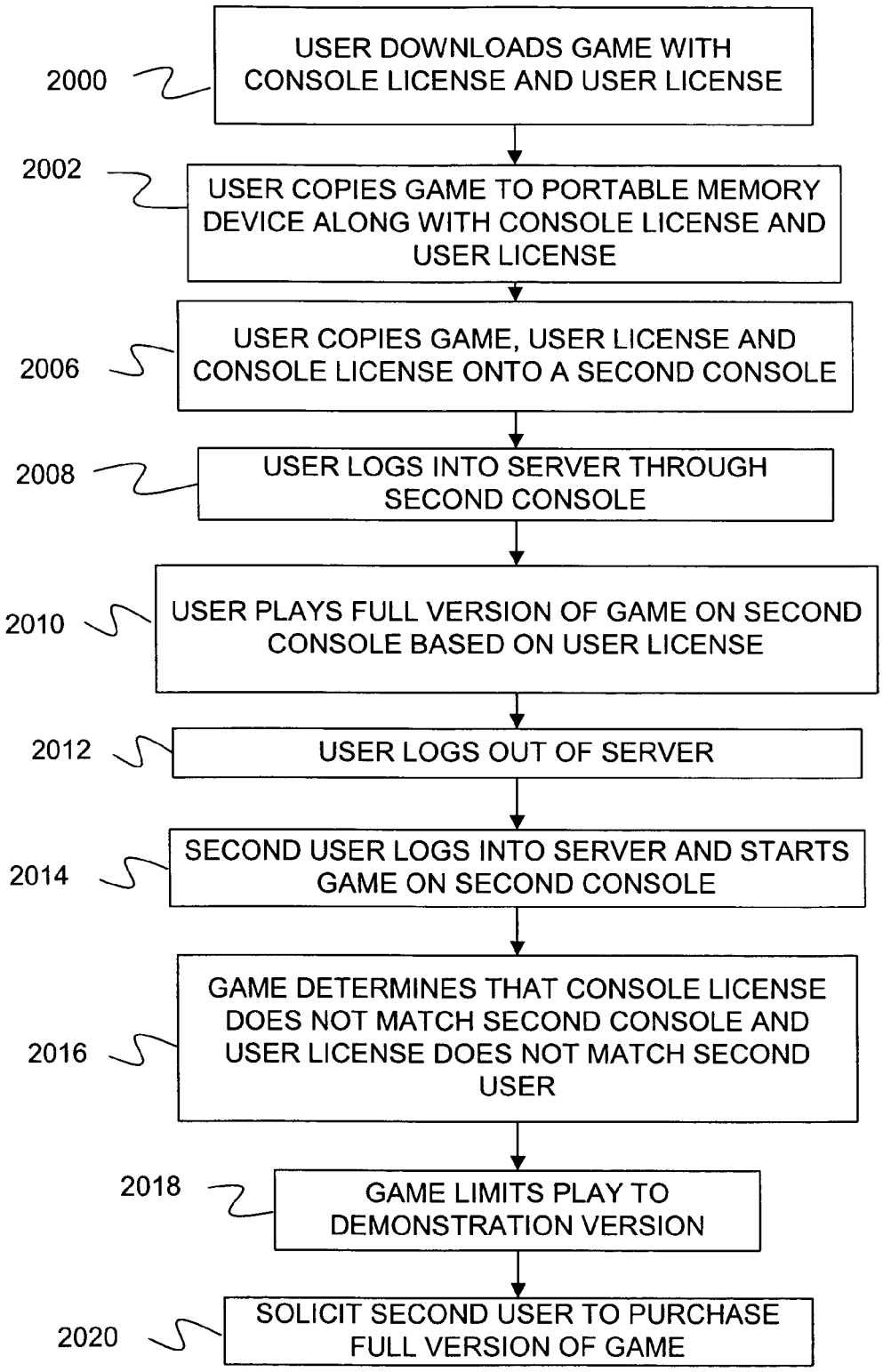
FIG. 20 is a flow diagram for viral licensing of a game.

As noted above, users are able to copy downloaded games from a hard disc drive on the console to a portable memory device. The user can then connect the portable memory device to a second console and upload the game onto that console. Thus, users can spread games from one console to another. A method under one embodiment capitalizes on this game movement to help drive sales of games. FIG. 20 provides a flow diagram for this method.

In step 2000 of FIG. 20, a first user on a first console downloads a game with a console license and a user license.

At step 2002, the user copies the game and the licenses to a portable memory device. Such portable memory devices can include flash memory units, portable hard disc drives, and other portable storage media. At step 2006, the user transports the memory device to another console and uploads the game onto the other console along with the user license and console license. At step 2008, the user logs into server 304 through the second console. The user then plays the full version of the game on the second console based on the user license at step 2010.

At step 2012 the user logs out of the server. At step 2014, a second user logs into the server and starts the game on the second console. At step 2016, the game queries for its licensing and determines that the console license on the game does not match the second console and that the user license does not match the second user. As a result, the game limits play to a demonstration version at step 2018 instead of the full version. At step 2020, the game solicits the user to purchase the full version of the game to obtain the full functionality that the first user had on the second console.

Thus, using the licensing scheme of the present invention, users who do not possess a full version of a game are enticed to purchase the full version of the game by watching a first user play the full version of the game on their console after the first user has copied the game onto the second console. In this manner, users help to drive the purchase of a game by other users by spreading the game to other consoles.

Driving Game Purchases Through Invites

Figure 21:
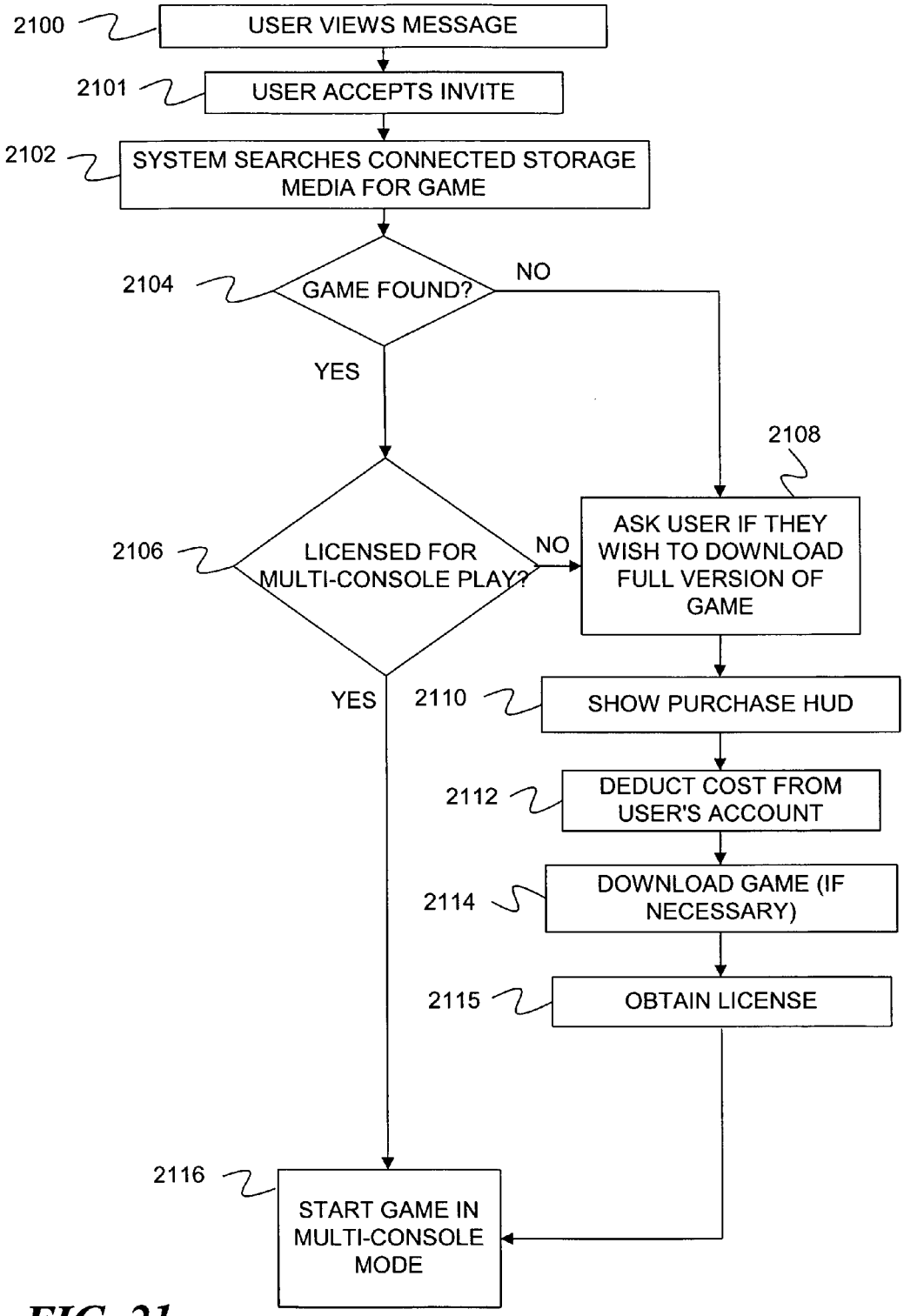
FIG. 21 is a flow diagram for driving viral purchases of a game through invites.

Under other embodiments, purchases of full versions of games are driven by utilizing invites sent from one user to another to play a multi-console game. FIG. 21 provides a flow diagram of a method for driving purchase of a game through invites.

Figure 22:
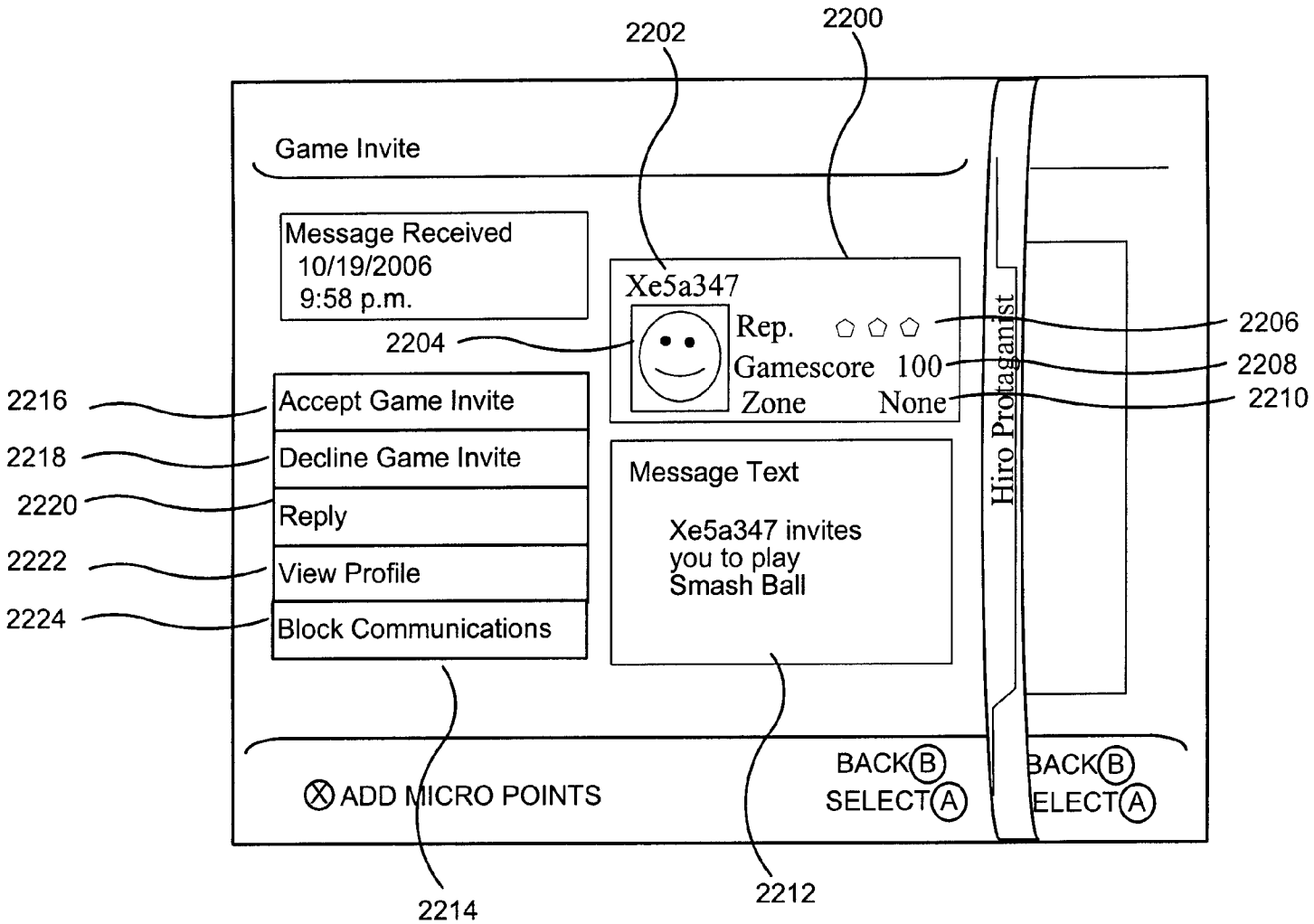
FIG. 22 is a user interface showing the details of an invite.

In step 2100 of FIG. 21, the user selects an invitation message from a message queue causing the invitation to be displayed on the screen in the user guide as shown in FIG. 22.

In FIG. 22, the invitation includes a gamer card 2200 that includes the Gamertag 2202, gamer icon 2204, reputation 2206, Gamerscore 2208 and zone 2210 of the gamer who has sent the invitation. The invitation also includes message text 2212, which indicates that a user with a particular Gamertag has invited this user to play a particular game. A command list 2214 is provided to the user and includes Accept Game Invite command 2216, Decline Game Invite command 2218, Reply command 2220, View Profile command 2222 and block communications command 2224. The user may highlight and select each of these commands using the game controller.

At step 2101 of FIG. 21, the user accepts the invite by selecting Accept Game invite command 2216. At step 2102, the console system searches all storage devices connected to the console to determine if the game associated with the invitation is stored on any of the storage devices. If the game is found on a storage device at step 2104, the licensing for the game is inspected at step 2106 to determine if it allows multi-console play. If the game is licensed for multi-console play, the game is started at step 2116 in a multi-console mode.

If the game is not found on a storage device at step 2104 or if the user does not have a license to play the game in multi-console mode at step 2106, the user is asked if they would like to download the full version of the game at step 2108. Thus, the invitation from another user has driven the solicitation of the user to purchase a full version of a game.

Figure 23:
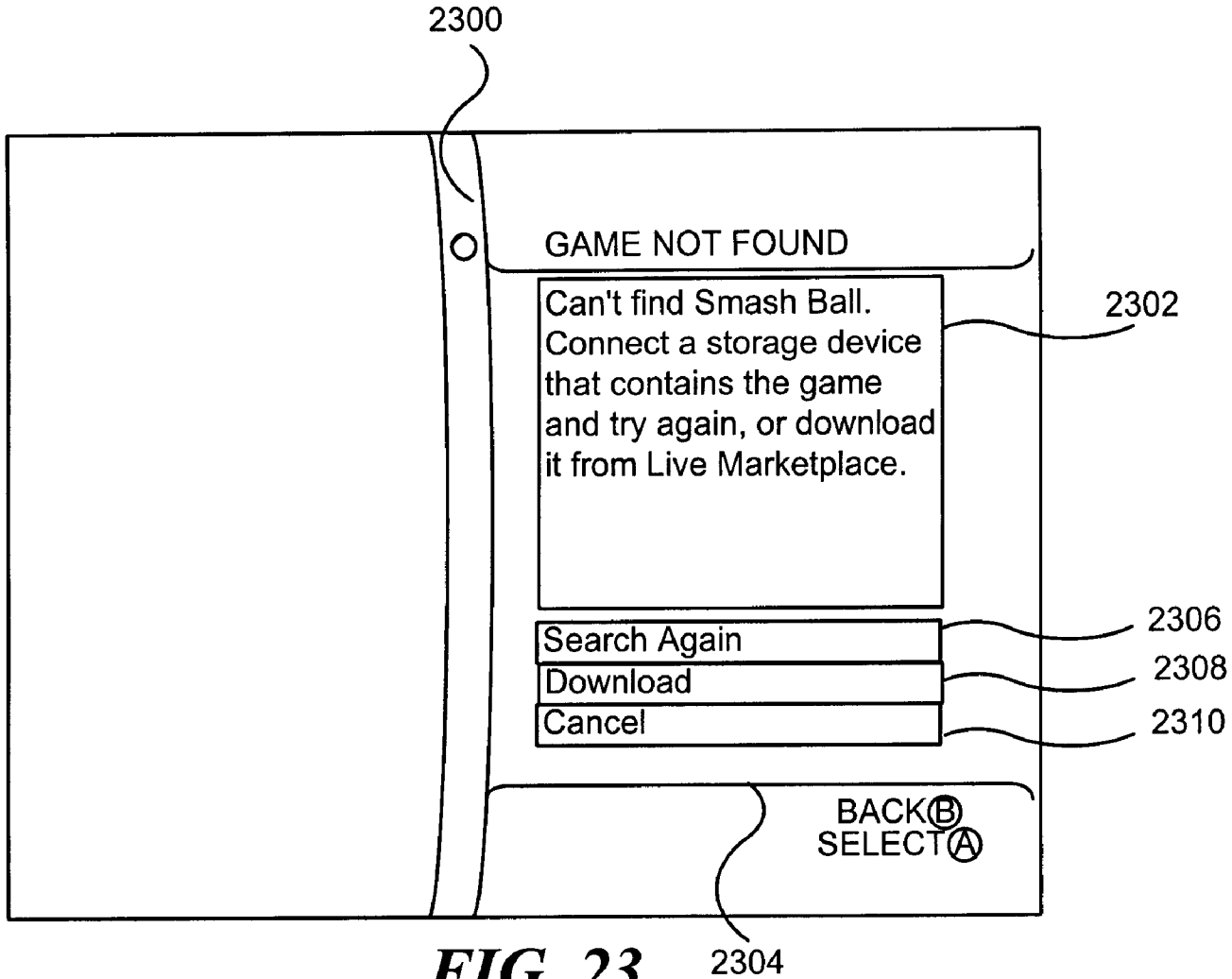
FIG. 23 is a user interface informing a user that they need to download a game.

FIG. 23 provides an example of a user interface in which the user is solicited to download the full version of the game. The user interface of FIG. 23 is a heads up display 2300 that extends out through an animation from the right side of the display on top of the other pages that were previously viewable on the display. The user interface includes text 2302 that tells the user that the game could not be found on any storage device and suggests that the user download the game from server 304. The user interface also includes a command list 2304 that includes a Search Again command 2306, a Download command 2308 and a Cancel command 2310. Search Again command 2306 would be used if the user has the game stored on a portable storage device, but the storage device was not connected to the console when the search was initially made. After attaching the storage device to the console, Search Again command 2306 can be used to find the game on the newly connected storage device. Download command 2308 can be used by the user to bring up the purchase heads up display at step 2110 of FIG. 21, which is similar to the purchase heads up display of FIG. 14. If the user confirms the download in the purchase HUD, the cost of the game is deducted from the user's account at step 2112 and the game is downloaded in the background at step 2114, if it was not previously downloaded. At step 2115 a license for the full version of the game is obtained using the method described in the flow diagram of FIG. 15. The game is then started in multi-console mode at step 2116.

Figure 24:
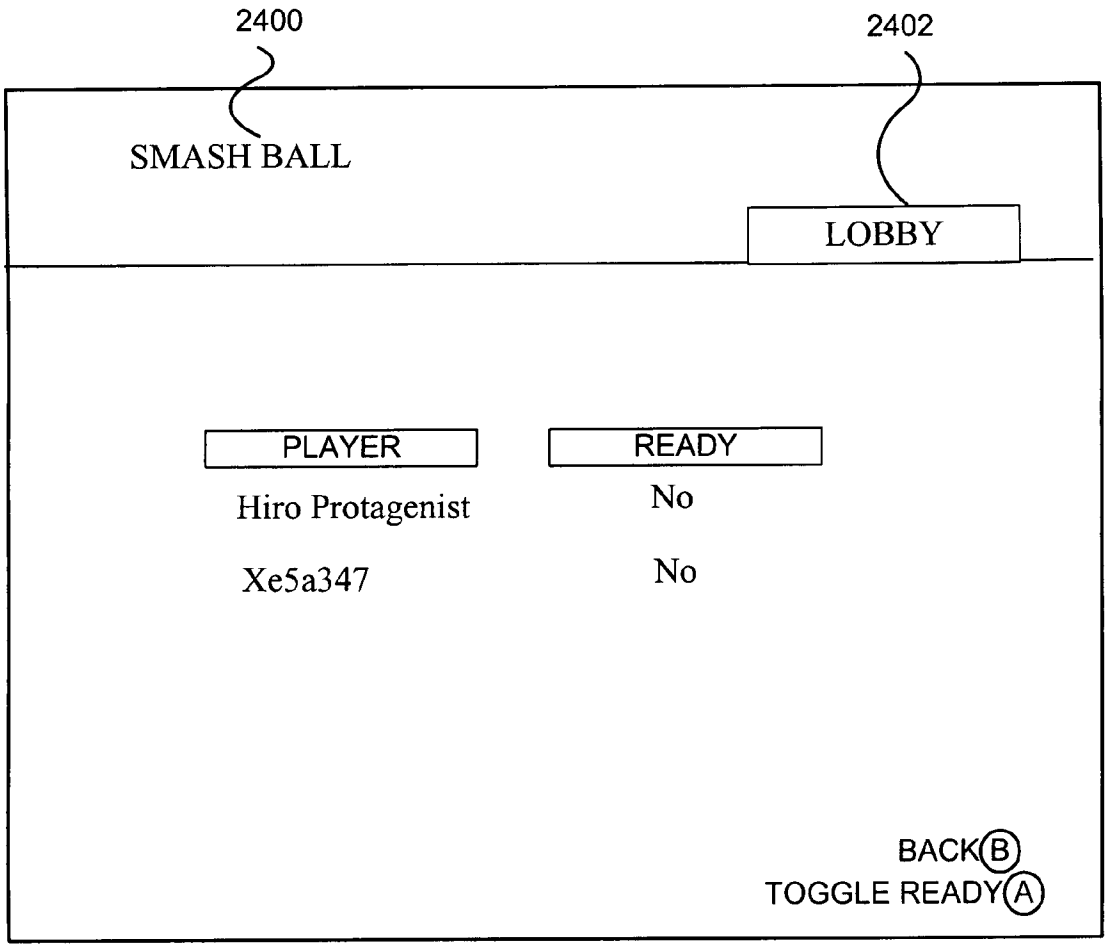
FIG. 24 is a user interface for multi-console play within an activated game.

FIG. 24 provides an example user interface of a game started in multi-console mode. In the user interface of FIG. 24, the name of the game is shown in a title bar 2400 and the user is informed that they are in the lobby through a text element 2402. The user interface lists the players that will be participating in the game and whether they are ready to play.

Thus, in the process of FIG. 21, one user's invitation to another user to play a game is utilized to drive the immediate purchase of the full version of the game on a console.

In the discussion above, references are made to demonstration versions and trial versions of games. Both of these terms are meant to reflect limited versions of games that are not as extensive as expanded versions of the games.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method comprising:

providing a user interface screen from a server to a gaming device, wherein the user interface screen provides a selectable item that indicates an ability to download games to the gaming device;

if a first user selects the selectable item, providing access to a user interface screen that provides a listing of games that may be downloaded to the gaming device;

receiving an indication from the gaming device via a user interface screen that the first user and a second user would like to play a session of a demonstration version of a game associated with a game title ID;

sending a game package to the gaming device, the game package including an expanded version of the game and a demonstration license for the game title ID that limits the first user and the second user to playing a session of the game in the demonstration version;

receiving an indication from the first user to purchase the expanded version of the game while the first user and the second user are playing the session of the game;

generating an expanded license for the game title ID that is associated with the first user, the expanded license allowing the expanded version of the game to be played by the first user and the second user without closing the session while the first user is logged into the server;

updating a record at the server to include the expanded license for the game title ID associated with the first user;

outputting a notification to the gaming device that there has been a change to licensing for the game;

receiving an indication that the first user is logging out of the server;

if the second user has not purchased the expanded license, outputting a notification to a gaming device of the second user that licensing for the game has been changed to the demonstration license for the second user during the session of the game without ending the session in response to the first user logging off of the server; and outputting a solicitation to the gaming device of the second user for the second user to purchase an expanded license that allows the second user to play the expanded version of the game.

2. The method of claim 1 wherein the user interface screen that provides the selectable item also provides a second selectable item that indicates an ability to view games that are stored on at least one storage device of the gaming device, and wherein that user interface screen is associated with the gaming device instead of a single application.

3. The method of claim 1, wherein providing access to the user interface screen that provides the listing of games that may be downloaded to the gaming device comprises:

requesting a listing of games from a server that is connected to the gaming device through a network; and displaying a modified listing of games.

4. The method of claim 1, wherein generating the expanded license includes generating a user license associated with a user ID of the first user;

wherein the user license specifies that the expanded version of the game is allowed to be played by the first user if the user is logged into the server with the user ID when a gaming device with any device ID attempts to execute the expanded version of the game.

5. The method of claim 4, wherein outputting the notification includes outputting the user license to the gaming device.

6. A method comprising:

receiving a request to launch a game at a server from a gaming device;

determining, at the server, that a demonstration license for the game limits a first user and a second user of the game to playing a limited version of the game although an expanded version of the game is available on the gaming device;

initiating, at the server, a session of the limited version of the game for the first user and the second user;

receiving, at the server, an indication that the first user wants to purchase the expanded version of the game before ending the session of the game;

obtaining, at the server, an expanded license that allows the first user to play the expanded version of the game with the second user while the first user is logged into the server;

outputting a notification to the gaming device that the first user has obtained the expanded license for the game;

receiving an indication that the user is logging out of the server;

if the second user has not purchased the expanded license, outputting a notification to a gaming device of the second user that licensing for the game has been changed to the demonstration license for the second user during the session of the game without ending the session in response to the first user logging off of the server; and outputting a solicitation to the gaming device of the second user for the second user to purchase an expanded license that allows the second user to play the expanded version of the game.

7. The method of claim 6 wherein receiving the indication that the user wants to purchase the expanded version of the game comprises:

receiving an indication that the session of the game is paused;

providing a purchase user interface with a selectable item for purchasing the expanded version of the game; and receiving an indication that the user has selected the selectable item for purchasing.

8. The method of claim 7 wherein the session of the game is resumed from the point it was paused with the expanded version of the game available to the first user and the second user in response to outputting the notification to the gaming device that the first user has obtained the expanded license.

9. The method of claim 8 wherein outputting the notification to the gaming device that the first user has obtained the expanded license further comprises:

sending a message to the gaming device that the license has changed;

receiving a request from the gaming device for license information about the game; and in response, providing the expanded license to the gaming device.

10. The method of claim 6 further comprising storing, on the server, the expanded license in association with a user ID corresponding to the first user.

11. The method of claim 1, where outputting the notification includes outputting the expanded license that allows play of the expanded version of the game without having to close, stop or restart the session of the game.

* * * * *